US006970668B2

(12) United States Patent
Ueno et al.

(10) Patent No.: US 6,970,668 B2
(45) Date of Patent: Nov. 29, 2005

(54) METHOD OF REPRODUCING PROCESS CARTRIDGE

(75) Inventors: Takahito Ueno, Shizuoka (JP); Atsushi Numagami, Kanagawa (JP); Akiyoshi Fujita, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 182 days.

(21) Appl. No.: 10/691,546

(22) Filed: Oct. 24, 2003

(65) Prior Publication Data

US 2005/0008391 A1 Jan. 13, 2005

(30) Foreign Application Priority Data

Oct. 31, 2002 (JP) ..... 2002-318642

(51) Int. Cl.[7] ..... G03G 15/00
(52) U.S. Cl. ..... 399/109
(58) Field of Search ..... 399/27, 29, 109, 399/257, 111, 113

(56) References Cited

U.S. PATENT DOCUMENTS

| | | | | |
|---|---|---|---|---|
| 5,243,388 | A * | 9/1993 | Berns et al. | 399/90 |
| 5,500,714 | A | 3/1996 | Yashiro et al. | 355/200 |
| 5,543,898 | A | 8/1996 | Shishido et al. | 355/210 |
| 5,617,579 | A | 4/1997 | Yashiro et al. | 399/114 |
| 5,937,242 | A | 8/1999 | Yokoyama et al. | 399/114 |
| 5,966,568 | A | 10/1999 | Numagami et al. | 399/111 |
| 6,016,413 | A | 1/2000 | Yokoyama et al. | 399/113 |
| 6,118,960 | A | 9/2000 | Nakagawa et al. | 399/111 |
| 6,219,506 | B1 * | 4/2001 | Morinaga et al. | 399/109 |
| 6,278,853 | B1 * | 8/2001 | Ban et al. | 399/109 |
| 6,397,025 | B1 * | 5/2002 | Higeta et al. | 399/109 |
| 6,519,430 | B2 | 2/2003 | Higeta et al. | 399/109 |
| 6,763,209 | B2 * | 7/2004 | Higeta et al. | 399/109 |
| 6,763,210 | B2 * | 7/2004 | Sato et al. | 399/109 |
| 6,808,255 | B1 * | 10/2004 | Haines et al. | 347/86 |
| 6,856,775 | B2 * | 2/2005 | Sekine | 399/109 |
| 2002/0028087 | A1 | 3/2002 | Higeta et al. | 399/109 |

FOREIGN PATENT DOCUMENTS

| | | | |
|---|---|---|---|
| GB | 2287904 A | * 10/1995 | G03G 21/00 |
| JP | 6-130740 | 5/1994 | |
| JP | 7-121086 | 5/1995 | |
| JP | 2002-14593 | 1/2002 | |

* cited by examiner

*Primary Examiner*—Robert Beatty
(74) *Attorney, Agent, or Firm*—Fitzpatrick, Cella, Harper & Scinto

(57) ABSTRACT

A method of refurbishing a process cartridge includes removing first and second side plates, a charging unit removing step, a drum removing step, a drum attaching step, a charging unit attaching step, and a positioning step of attaching the first and second side plates to the development unit, to which the drum and the charging unit are attached, positioning the development and charging units by the first side plate as well as movably supporting the drum in a direction perpendicular to the lengthwise direction, and positioning the development and charging units and the drum by the second side plate. Another reproducing method includes opening an open/close shutter of a developing agent replenishing port, evacuating the developing agent in the development unit from the development agent replenishing port, filling a new developing agent from the developing agent replenishing port, and closing the open/close shutter.

14 Claims, 14 Drawing Sheets

METHOD OF REPRODUCING PROCESS CARTRIDGE

BACKGROUND OF THE INVENTION

1. Field of the Invention

The present invention relates to a method of refurbishing a process cartridge detachably attachable to, for example, the main body of an electrophotographic image forming apparatus.

The electrophotographic image forming apparatus is an apparatus for forming an image on a recording medium using an electrophotographic image forming process.

An electrophotographic copy machine, an electrophotographic printer (a laser printer, an LED printer, and the like) a facsimile apparatus, a word processor, and the like, for example, are included as an example of the electrophotographic image forming apparatus.

Further, the process cartridge includes at least one of charging means, developing means, and cleaning means and a photosensitive drum acting as an electrophotographic sensitive member, which are integrated into a cartridge, and the process cartridge is detachably attachable to the main body of the electrophotographic image forming apparatus.

2. Related Background Art

Heretofore, an image forming apparatus using an electrophotographic image forming process employs a process cartridge system in which an electrophotographic photosensitive member and process means that acts on the electrophotographic photosensitive member are intergrated into a cartridge and the cartridge is detachably attachable to the main body of an electrophotographic image forming apparatus.

According to the process cartridge system, since the maintenance of the apparatus can be executed by a user without depending on a service man, the operability of the apparatus can be greatly enhanced.

Since the process cartridge forms an image on a recording medium using a developing agent, the developing agent is consumed and deteriorates as images are formed. When the developing agent is consumed and deteriorates to such a degree that an image cannot be formed, the process cartridge loses its commercial value.

To cope with this problem, although the process cartridge must be replaced, it is recently desired to reuse the process cartridge whose life has been ended as far as possible from a viewpoint of environmental conservation, and refurbishing of process cartridges has been conducted.

As a conventional method of refurbishing the process cartridge, there is a method of breaking down and refurbishing a cartridge composed of a developing agent frame or a developing frame swingably coupled with a drum frame by breaking down a cartridge main body by extracting a pin or the like that swingably couples both frames (refer to, for example, Japanese Patent Application Laid-Open Nos. 2002-14593 (pages 23–26) and H07-121086 (pages 22–25).

Further, there is a method of breaking down and refurbishing a cartridge composed of a plurality of frames separably coupled with each other by separating a developing agent frame from a development frame (refer to, for example, Japanese Patent Application Laid-Open No. H06-130740 (pages 5–7).

However, since the conventional process cartridge refurbishing methods as described above are very troublesome and time consuming, a simpler refurbishing method has been desired.

Further, there has been desired a simple refurbishing method capable of recommercializing a process cartridge whose commercial value is lost owing to the developing agent contained therein being consumed and deteriorating.

SUMMARY OF THE INVENTION

An object of the present invention is to provide a method of simply refurbishing a process cartridge.

Another object of the present invention is to provide a process cartridge refurbishing method capable of recommercializing a process cartridge whose developing agent is consumed and suffered deterioration to such a degree that an image having quality satisfactory to a user cannot be formed.

Still another object of the present invention is to provide a method of refurbishing a process cartridge that is detachably attachable to the body of an electrophotographic image forming apparatus and comprises an electrophotographic photosensitive drum, a charging unit for charging the electrophotographic photosensitive drum, and a development unit for developing a latent image formed on the electrophotographic photosensitive drum using a development roller, wherein the electrophotographic photosensitive drum and the charging unit are attached to the development unit, the method comprising:

(a) a side plate removing step of removing first and second side plates disposed at both lengthwise ends of the process cartridge;

(b) a charging unit detaching step of detaching the charging unit from the development unit;

(c) an electrophotographic photosensitive drum removing step of removing the electrophotographic photosensitive drum from the development unit;

(d) a shaft extracting step of extracting a shaft from the electrophotographic photosensitive drum;

(e) a shaft inserting step of inserting a shaft into a new electrophotographic photosensitive drum;

(f) an electrophotographic photosensitive drum attaching step of attaching the new electrophotographic photosensitive drum to the development unit;

(g) a charging unit attaching step of attaching the charging unit to the development unit to which the new electrophotographic photosensitive drum is attached; and (h) a positioning step of attaching the first and second side plates to the development unit to which the electrophotographic photosensitive drum and the charging unit are attached, positioning the development unit and the charging unit by the first side plate as well as supporting the electrophotographic photosensitive drum movably in a direction perpendicular to the lengthwise direction, and positioning the development unit, the charging unit and the electrophotographic photosensitive drum by the second side plate.

A further object of the present invention is to provide a method of refurbishing a process cartridge that is detachably attachable to the body of an electrophotographic image forming apparatus and comprises an electrophotographic photosensitive drum, a charging unit for charging the electrophotographic photosensitive drum, and a development unit for developing a latent image formed on the electrophotographic photosensitive drum using a development roller, wherein the electrophotographic photosensitive drum and the charging unit are attached to the development unit, the method comprising:

(a) a side plate removing step of removing first and second side plates disposed at both lengthwise ends of the process cartridge;

(b) a charging unit detaching step of detaching the charging unit from the development unit;

(c) an electrophotographic photosensitive drum removing step of removing the electrophotographic photosensitive drum from the development unit;

(d) an electrophotographic photosensitive drum attaching step of attaching a new electrophotographic photosensitive drum to the development unit;

(e) a charging unit attaching step of attaching the charging unit to the development unit to which the electrophotographic photosensitive drum is attached; and (f) a positioning step of attaching the first and second side plates to the development unit to which the electrophotographic photosensitive drum and the charging unit are attached, positioning the development unit and the charging unit by the first side plate as well as supporting the electrophotographic photosensitive drum movably in a direction perpendicular to the lengthwise direction, and positioning the development unit, the charging unit and the electrophotographic photosensitive drum by the second side plate.

A still further object of the present invention is to provide a method of refurbishing a process cartridge that is detachably attachable to the body of an electrophotographic image forming apparatus and comprises an electrophotographic photosensitive drum, a charging unit for charging the electrophotographic photosensitive drum, and a development unit for developing a latent image formed on the electrophotographic photosensitive drum using a development roller, wherein the electrophotographic photosensitive drum and the charging unit are attached to the development unit, the method comprising:

(a) a side plate removing step of removing first and second side plates disposed at both lengthwise ends of the process cartridge;

(b) a charging unit detaching step of detaching the charging unit from the development unit;

(c) an electrophotographic photosensitive drum removing step of removing the electrophotographic photosensitive drum from the development unit;

(d) a cover member removing step of removing from the development unit a cover member for covering the surface of the development roller except the portion thereof facing the electrophotographic photosensitive drum and holding a sheet member in contact with the electrophotographic photosensitive drum in the lengthwise direction;

(e) a pin member extracting step of extracting from the development first and second pin members for fixing bearings that rotatably support the development roller at both the ends thereof;

(f) a regulation member removing step of removing from the development unit a regulation member for regulating the angle in a rotational direction of a magnet roller included in the development roller;

(g) a development roller removing step of removing the development roller from the development unit;

(h) a developing agent evacuating step of evacuating the developing agent in the development unit from the opening of the development unit that appears when the development roller is removed;

(i) a developing agent removing step of removing the developing agent deposited on the development roller;

(j) a developing agent filling step of filling new developing agent from the opening of the development unit;

(k) a development roller attaching step of attaching the development roller to the development unit;

(l) a regulation member attaching step of attaching the regulation member to the development unit;

(m) a pin member attaching step of attaching the first and second pin members to the development unit;

(n) a cover member attaching step of attaching the cover member to the development unit;

(o) an electrophotographic photosensitive drum attaching step of attaching the electrophotographic photosensitive drum to the development unit;

(p) a charging unit attaching step of attaching the charging unit to the development unit to which the electrophotographic photosensitive drum is attached; and (q) a positioning step of attaching the first and second side plates to the development unit to which the electrophotographic photosensitive drum and the charging unit are attached, positioning the development unit and the charging unit by the first side plate as well as supporting the electrophotographic photosensitive drum movably in a direction perpendicular to the lengthwise direction, and positioning the development unit, the charging unit and the electrophotographic photosensitive drum by the second side plate.

A yet still further object of the present invention is to provide a method of refurbishing a process cartridge that is detachably attachable to the body of an electrophotographic image forming apparatus and comprises an electrophotographic photosensitive drum, a charging unit for charging the electrophotographic photosensitive drum, and a development unit for developing a latent image formed on the electrophotographic photosensitive drum using a development roller, wherein the electrophotographic photosensitive drum and the charging unit are attached to the development unit, the method comprising:

(a) an open/close shutter opening step of opening an open/close shutter of a developing agent replenishing port disposed in the development unit;

(b) a first developing agent evacuating step of evacuating the developing agent in the development unit from the developing agent replenishing port whose open/close shutter is opened;

(c) an open/close shutter closing step of closing the open/close shutter;

(d) a side plate removing step of removing first and second side plates disposed at both lengthwise ends of the process cartridge;

(e) a charging unit detaching step of detaching the charging unit from the development unit;

(f) an electrophotographic photosensitive drum removing step of removing the electrophotographic photosensitive drum from the development unit;

(g) a cover member removing step of removing from the development unit a cover member for covering the surface of the development roller except the portion thereof facing the electrophotographic photosensitive drum and holding a sheet member in contact with the electrophotographic photosensitive drum in the lengthwise direction;

(h) a pin member extracting step of extracting from the development unit first and second pin members for fixing bearings that rotatably support the development roller at both the ends thereof;

(i) a regulation member removing step of removing from the development unit a regulation member for regulating the angle in a rotational direction of a magnet roller included in the development roller;

(j) a development roller removing step of removing the development roller from the development unit;

(k) a second developing agent evacuating step of evacuating the developing agent in the development unit from the opening of the development unit that appears when the development roller is removed;

(l) a developing agent removing step of removing the developing agent deposited on the development roller;

(m) a developing agent filling step of filling new developing agent from the opening of the development unit;

(n) a development roller attaching step of attaching the development roller to the development unit;

(o) a regulation member attaching step of attaching the regulation member;

(p) a pin member attaching step of attaching the first and second pin members to the development unit;

(q) a cover member attaching step of attaching the cover member to the development unit;

(r) an electrophotographic photosensitive drum attaching step of attaching the electrophotographic photosensitive drum to the development unit;

(s) a charging unit attaching step of attaching the charging unit to the development unit to which the electrophotographic photosensitive drum is attached; and (t) a positioning step of attaching the first and second side plates to the development unit to which the electrophotographic photosensitive drum and the charging unit are attached, positioning the development unit and the charging unit by the first side plate as well as supporting the electrophotographic photosensitive drum movably in a direction perpendicular to the lengthwise direction, and positioning the development unit, the charging unit and the electrophotographic photosensitive drum by the second side plate.

DETAILED DESCRIPTION OF THE PREFERRED EMBODIMENTS

Preferred embodiments of the present invention will be explained below in detail with reference to the drawings. However, the scope of the present invention is by no means limited only to the size, the material, and the shape of the components, the relative positions of the components, and the like described in the embodiments unless otherwise specified.

(First Embodiment)

A color electrophotographic image forming apparatus according to a first embodiment will be explained below with reference to the drawings. In the following explanation, the lengthwise direction is the same direction as the axial direction of an electrophotographic photosensitive member (hereinafter, referred to as a photosensitive drum 2) that is perpendicular to the transporting direction of a recording medium 52. Right and left directions are both the right and left sides of a direction in which the recording medium 52 is transported. Further, the upper and lower directions are the upper and lower sides of an attached cartridge.

<Explanation of Overall Image Forming Apparatus>

First, the overall arrangement of a color toner electrophotographic image forming apparatus will be schematically explained with reference to FIG. 1.

Figure 1:
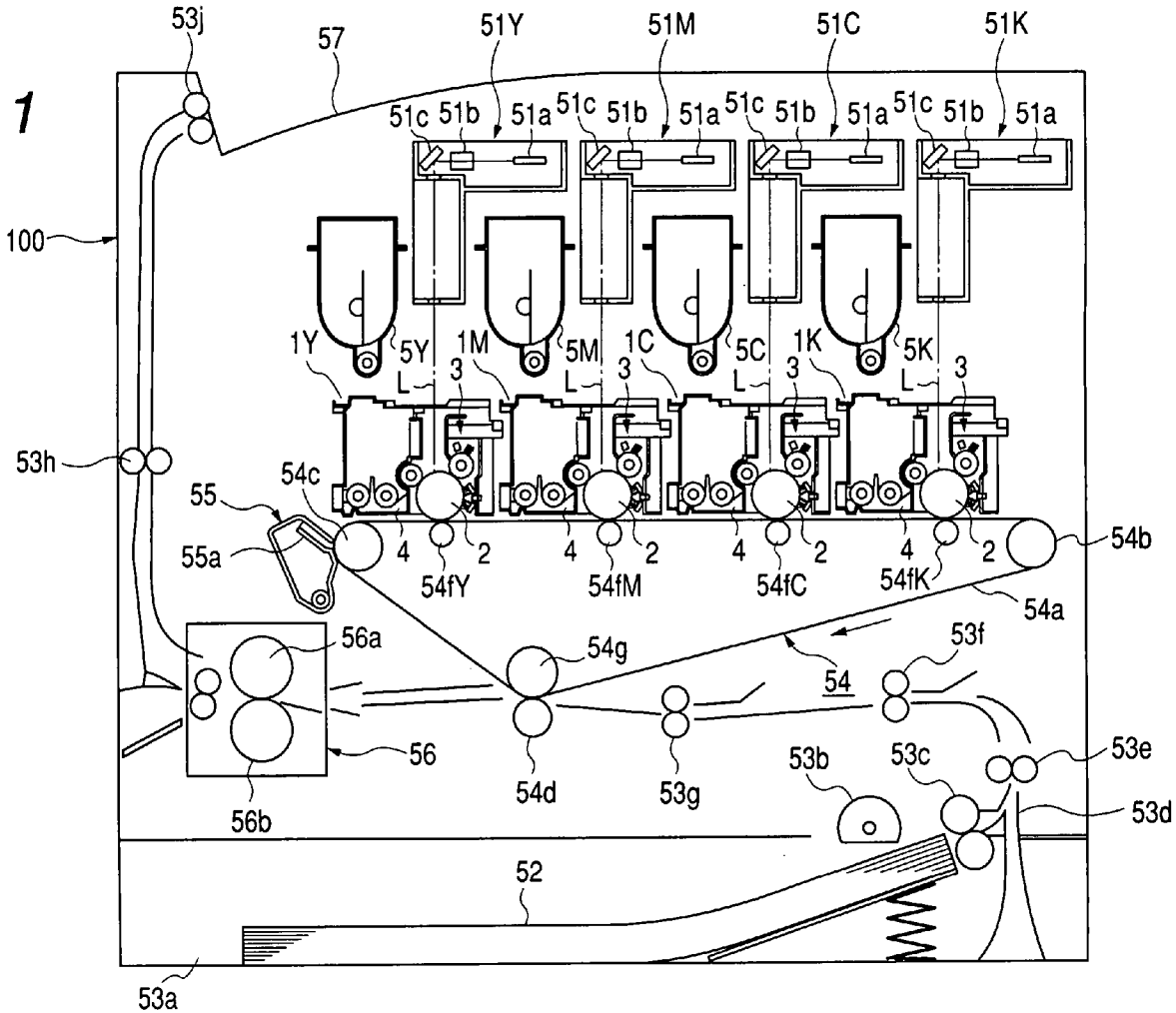
FIG. 1 is a schematic longitudinal sectional view of the main body of a color electrophotographic image forming apparatus according to a first embodiment.

FIG. 1 is a view explaining the overall arrangement of a color laser beam printer as an example of the color toner image forming apparatus.

An image forming section of the apparatus body 100 of the color laser beam printer includes four process cartridges 1Y, 1M, 1C, 1K (yellow, magenta, cyan, and black) each provided with the photosensitive drum 2, i.e. an electrophotographic photosensitive member acting as an image bearing member. Further, exposure means 51Y, 51M, 51C, 51K (laser beam optical scanning system) are disposed in parallel with each other above the process cartridges 1Y, 1M, 1C, 1K, respectively in correspondence to the respective colors.

A sheet feeding section for feeding the recording medium 52 and transfer means are disposed below the image forming section, the transfer means being composed of an intermediate transfer belt 54*a* onto which a toner image formed on a photosensitive drum 2 is transferred and a secondary transfer roller 54*d* for transferring the toner image formed on the intermediate transfer belt 54*a* onto the recording medium 52.

Further, fixing means for fixing the recording medium 52 onto which the toner image is transferred and discharge means for discharging the recording medium 52 to the outside of the apparatus and stacking it are disposed below the image forming section.

A paper sheet, an OHP sheet (overhead projector sheet), a cloth and the like, for example, are used as the recording medium 52.

The apparatus body 100 of this embodiment is an apparatus employing a cleanerless system. Since toner remaining on the photosensitive drum 2 without being transferred (hereinafter, referred to as "remaining toner") is captured by development means, a dedicated cleaner is not disposed in each process cartridge to collect and store the remaining toner.

Next, the arrangements of the respective components of the image forming apparatus will be explained below in detail.

<Sheet Feeding Section>

The sheet feeding section feeds the recording medium 52 to the image forming section. The sheet feeding section is mainly composed of a sheet feeding cassette 53*a* on which a plurality of the recording media 52 are stacked, a sheet feeding roller 53*b*, retard rollers 53*c* for preventing the feed of overlapped sheets, a sheet feeding guide 53*d*, and registration rollers 53*g*.

The sheet feeding roller 53*b* is rotated in accordance with an image forming operation and feeds the recording media 52 in the sheet feeding cassette 53*a* one by one in a separated state. The recording medium 52 is guided by the sheet feeding guide 53*d* and transported to the registration rollers 53*g* through transportation rollers 53*e* and 53*f*.

The rotation of the registration rollers 53*g* is stopped just after the recording medium 52 is transported, and the oblique travel of the recording media 52 can be corrected by the abutment of the recording media 52 against the nip portion of the registration rollers 53*g*.

During the image forming operation, the registration rollers 53*g* execute a non-rotating operation, in which the recording medium 52 waits in a stationary state, and a rotating operation, in which the recording medium 52 is transported to the intermediate transfer belt 54*a*, in a predetermined sequence, and they align the toner image for a next image transfer step with the recording medium 52.

<Process Cartridge>

Each of the process cartridges 1Y, 1M, 1C, 1K includes charging means and development means disposed around the photosensitive drum 2 and is arranged integrally therewith. These cartridges 1Y, 1M, 1C, 1K can be easily removed from the apparatus body 100 by a user and replaced with new ones when the life of the photosensitive drum 2 is ended.

In this embodiment, the number of rotations of the photosensitive drum 2, for example, is counted, and when it exceeds a predetermined number of counts, a notification is produced, the notification indicating that the life of the cartridges 1Y, 1M, 1C, 1K is ended.

The photosensitive drum 2 of the embodiment is a negatively charged organic photosensitive member composed of an aluminum drum substrate which has a diameter of about 30 mm. On the drum substrate an ordinarily used photosensitive member layer is formed and a charge injection layer is formed on the outermost layer thereof. Used as the charge injection layer is a coated layer composed of a material in which ultrafine $SnO_2$ particles are dispersed as conductive fine particles acting as an insulating resin binder.

The photosensitive drum 2 is rotated at a predetermined process speed, i.e. about 117 mm/sec in this embodiment.

Figure 4:
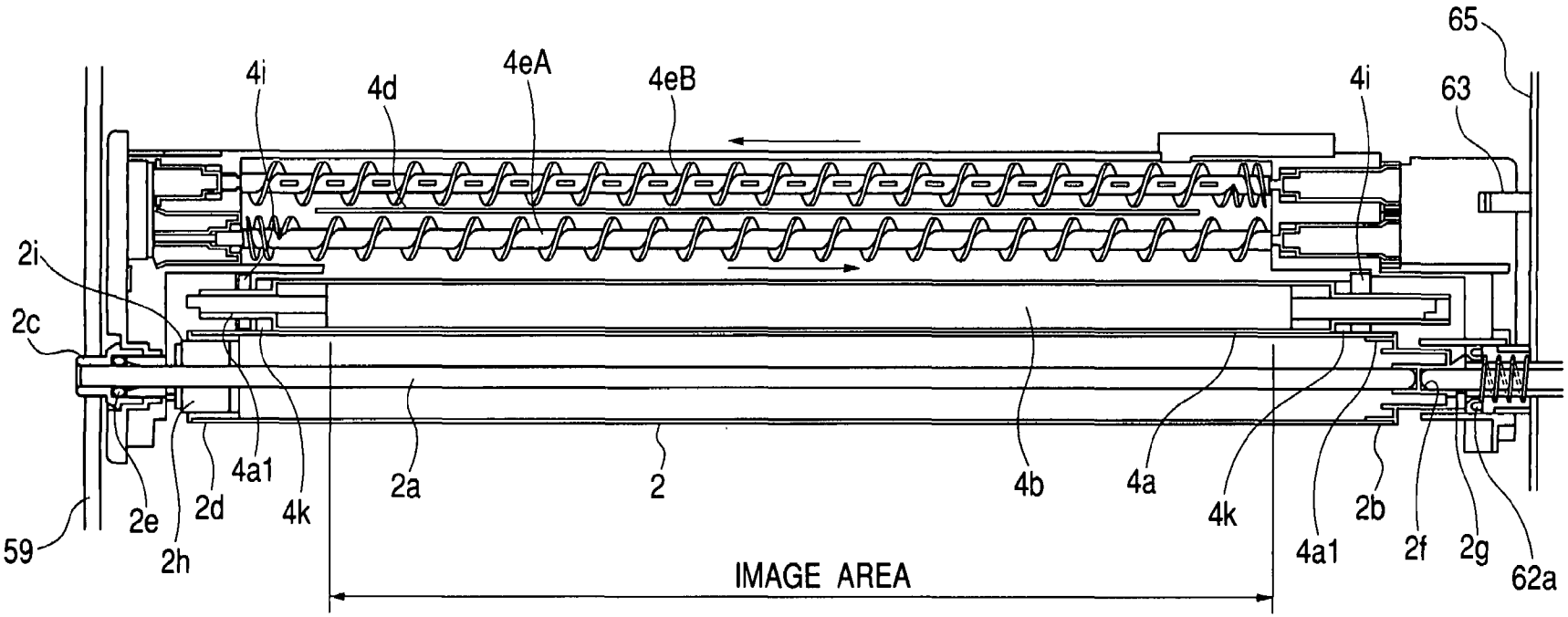
FIG. 4 is a schematic lateral sectional view of the process cartridge in a longitudinal direction according to the first embodiment.

As shown in FIG. 4, a drum flange 2*b* is fixed to the photosensitive drum 2 at the inner side end thereof, and a non-driven side flange 2*d* is fixed to the photosensitive drum 2 at the outer side end thereof. A drum shaft 2*a* passes through the center of the flanges 2*b* and 2*d*. The drum shaft 2*a* and the flanges 2*b* and 2*d* are rotated integrally with each other. That is, the photosensitive drum 2 is rotated about the axis of the drum shaft 2*a*.

The drum shaft 2*a* is rotatably supported by a bearing 2*e* at the outer side end thereof. The bearing 2*e* is fixed to a bearing case 2*c*. The bearing case 2*c* is fixed to the frame of the cartridges 1Y, 1M, 1C, 1K.

<Charging Means>

The charging means in this embodiment employs a contact charging method. A charging roller 3*a* is used as a charging member in contact with the photosensitive drum 2.

Figure 2:
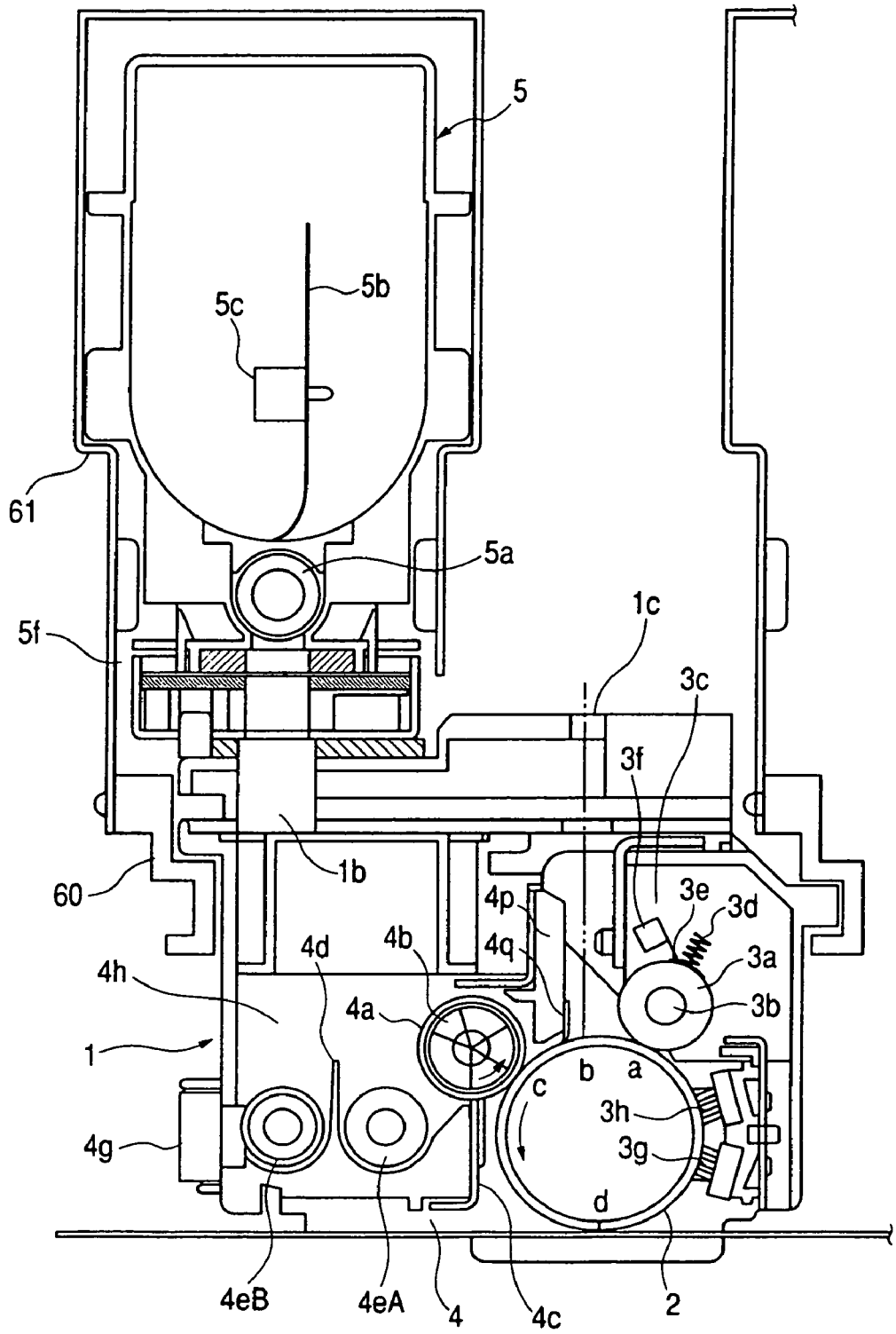
FIG. 2 is a schematic longitudinal sectional view of a process cartridge and a toner replenishing container according to the first embodiment.

As shown in FIG. 2, the charging roller 3*a* is rotatably supported by bearing members (not shown) at both the ends of a metal core 3*b*. Further, the charging roller 3*a* is caused to come into pressure contact with the surface of the photosensitive drum 2 with a predetermined press force by being urged in the direction of the photosensitive drum 2 by a presser spring 3*d* and is rotated by rotating the photosensitive drum.

Reference numeral 3*c* denotes a charging roller cleaning member composed of a flexible cleaning film 3*e* and a supporting member 3*f* for supporting the film 3*e*.

The film 3*e* is disposed in parallel with the charging roller 3*a* in the lengthwise direction thereof. Further, the film 3*e* is disposed such that it is fixed to the supporting member 3*f* at an end thereof and forms a contact nip together with the charging roller 3*a* on the surface of it in the vicinity of the free end thereof, the supporting member 3*f* making a predetermined amount of reciprocating motion in the lengthwise direction. When the supporting member 3*f* is reciprocatingly driven by the predetermined amount in the lengthwise direction by unillustrated drive means, the surface of the charging roller 3*a* is in sliding contact with the film 3*e*. With this operation, materials (fine powder toner, external additives, and the like) deposited on the surface of the charging roller 3*a* are removed.

Note that the image forming apparatus of this embodiment employs the cleanerless system which will be explained below.

<Cleanerless System>

First, the cleanerless system employed in the image forming apparatus of this embodiment will be explained. In the cleanerless system, the toner remaining on the photosensitive drum 2 after it is transferred is carried to a development section "c" passing through a charging section "a" and an exposure section "b", as the photosensitive drum 2 rotates successively. Then, the remaining toner is simultaneously developed and cleaned (collected) by the development means.

Since the remaining toner on the surface of the photosensitive drum 2 passes through the exposure section "b", an exposure step is executed through the remaining toner. However, the exposure step is not greatly affected by the remaining toner because its amount is small.

However, the remaining toner is a mixture of toner having a normal polarity, toner having a reverse polarity (reversed toner), and toner having a small amount of charge. Since the toner having the reversed polarity and the toner having the small amount of charge are deposited on the charging roller 3*a* when they pass through the charging section "a", the charging roller 3*a* is badly charged because it is polluted with the toner in an amount exceeding an allowable limit.

Further, to effectively execute the simultaneous development and cleaning of the toner remaining on the surface of the photosensitive drum 2 by the development means, it is essential that the charged polarity of the toner, which remains on the surface of the photosensitive drum 2 and is carried to the development section c, be the normal polarity as well as having an amount of charge that is sufficient for the development means to develop an electrostatic latent image on the photosensitive drum 2. The reversed toner and the toner having an insufficient amount of charge cannot be removed or collected from the photosensitive drum 2 by the development means and they cause a faulty image.

Further, as the needs of users have diversified in recent years, it is common for an image, such as a photographic image having a high print rate, to be continuously printed, generating a large amount of remaining toner at one time, which further contributes to the occurrence of the above problem.

To cope with the problem, the embodiment is provided with remaining toner (image of a remaining developing agent) uniforming means 3*g* to make the toner remaining on the photosensitive drum 2 uniform at a position downstream of a transfer section d in the rotating direction of the photosensitive drum 2. Further, toner (developing agent) charge control means 3*h* is disposed at a position downstream of the remaining toner uniforming means 3*g* in the rotating direction of the photosensitive drum 2 and upstream of the charging section "a" in the rotating direction thereof to make the charged polarity of the remaining toner a negative polarity as the normal polarity.

The toner remaining on a pattern on the photosensitive drum 2, which is carried from the transfer section d to the toner charge control means 3*h*, is dispersed and distributed on the photosensitive drum 2 by the remaining toner uniforming means 3*g* even if its amount is large, so that the toner is placed in a non-pattern state.

Accordingly, since no toner is concentrated to a part of the toner charge control means 3*h*, the remaining toner is sufficiently charged to the normal polarity in its entirely at all times by the toner charge control means 3*h*, thereby effectively preventing the deposition of the remaining toner on the charging roller 3*a*. Further, the occurrence of a ghost image from the remaining toner image pattern can be prevented.

In this embodiment, the toner uniforming means 3*g* and the toner charge control means 3*h* are composed of a brush-like member having an appropriate conductivity, and disposed with the brush portions thereof in contact with the surface of the photosensitive drum 2.

Further, the toner uniforming means 3*g* and the toner charge control means 3*h* are moved (reciprocated) in the lengthwise direction of the photosensitive drum 2 by an unillustrated drive source. With the above arrangement, the toner uniforming means 3*g* and the toner charge control means 3*h* are not continuously located at the same position on the photosensitive drum 2. When an excessively charged portion and an insufficiently charged portion exist due to, for example, the irregular resistance of the toner charge control means 3*h*, they do not occur at the same portion of the surface of the photosensitive drum 2 at all times. Therefore, it is prevented or eased that fusion occurs on the photosensitive drum 2 due to the excessive charging of locally remaining toner and that the remaining toner is deposited on the charging roller 3*a* by the insufficient charging thereof.

<Exposure Means>

In this embodiment, the photosensitive drum 2 is exposed using laser exposure means. That is, when an image signal is sent, the uniformly charged surface of the photosensitive drum 2 is scanned and exposed with laser beams L modulated according to the signal. Then, an electrostatic latent image is selectively formed on the surface of the photosensitive drum 2 in correspondence to image information.

The laser exposure means is composed of a solid laser element (not shown), a polygon mirror 51*a*, an imaging lens 51*b*, a reflection mirror 51*c*, and the like.

The solid laser element is turned on and off by a light emission signal generator (not shown) in response to the image signal input thereto. The laser beams L emitted from the solid laser element are converted into approximately parallel light beams by a collimator lens system (not shown) and scanned by the polygon mirror 51*a* rotating at a high speed. Then, the light beams are imaged on the photosensitive drum 2 in a spot shape through the imaging lens 51*b* and the reflection mirror 51*c*.

As described above, the surface of the photosensitive drum 2 is exposed in a main scanning direction by the scan executed by the laser beams and further exposed in a sub-scanning direction by the rotation of the photosensitive drum 2, whereby the exposure distribution according to the image signal is obtained.

More specifically, bright potentials, in which a surface potential drops, and dark potentials, in which no surface potential drops, are formed by emitting and non-emitting the laser beams L. Then, the electrostatic latent image according to the image information is formed by the contrast between the bright potentials and the dark potentials.

<Development Means>

A development device 4 as the development means is a two-component contact development device (two-component magnetic brush development device) which holds a developing agent composed of carriers and toner on a development sleeve 4*a* acting as a developing agent bearing member that contains a magnet roller 4*b* as shown in FIG. 2.

A regulation blade 4*c* acting as a layer thickness regulation member is disposed above the development sleeve 4*a* at a predetermined gap therebetween to regulate the layer thickness of the developing agent on the surface of the development sleeve 4*a* to a predetermined layer thickness. As the development sleeve 4*a* is rotated in the direction of an arrow, a thin layer of the developing agent is formed thereon.

As shown in FIG. 4, the sleeve 4*a* is disposed at a predetermined gap with respect to the photosensitive drum 2 by rotatably fitting spacers 4*k* (FIGS. 4, 7, and 14) on the diameter-reduced journals 4*a*1 of the sleeve 4*a* on both sides thereof. The predetermined gap is so determined that the developing agent formed on the sleeve 4*a* is in contact with the photosensitive drum 2 in development. The sleeve 4*a* is rotated in the development section c at a predetermined peripheral speed in a clockwise direction as shown by an arrow in FIG. 2, i.e. in a counter direction with respect to the rotational direction of the photosensitive drum 2.

The toner used in this embodiment is negatively charged toner having an average particle size of 6 $\mu$m, and magnetic carriers, which have a saturation magnetization of 205 emu/cm$^3$ and an average particle size of 35 $\mu$m, are used in the embodiment. Further, the toner and the carriers mixed at a weight ratio of 6:94 are used as the developing agent.

A developing agent accommodation unit 4*h*, in which the developing agent circulates, is partitioned into two compartments by a partition wall 4*d* in the lengthwise direction except at both end portions thereof. Stirring screws 4*e*A and 4*e*B are disposed on both the sides of the partition wall 4*d*.

As shown in FIG. 4, the toner supplied from a toner replenishing container 5 drops to the back side of the stirring screw 4*e*B, is stirred while being fed to the front side in the lengthwise direction, and passes through a portion without the partition wall 4*d* at a front side end. Then, the toner is further fed to the back side in the lengthwise direction by the stirring screw 4eA, passes through a portion without the partition wall 4d on the back side, and is stirred by the stirring screw 4eB while being fed thereby so as to repeat the circulation operation.

A development step for making the electrostatic latent image formed on the photosensitive drum 2 visible by the two-component magnetic brush method using the development device 4, and a circulating system of the developing agent, will be explained.

As the sleeve 4a rotates, the developing agent in the developing agent accommodation unit 4h is drawn up onto the surface of the sleeve 4a by the drawing pole of the magnet roller 4b and transported.

In the transportation process of the development agent, the layer thickness of the developing agent is regulated by the regulation blade 4c disposed perpendicularly to the sleeve 4a so that a thin layer of the developing agent is formed on the sleeve 4a. When the thin layer of the developing agent is transported to the development pole corresponding to the development section "c", naps (bead chain) are formed by a magnetic force.

The electrostatic latent image on the surface of the photosensitive drum 2 is developed as a toner image by the toner in the developing agent formed in the nap shape. In this embodiment, the electrostatic latent image is developed inversely.

The thin layer developing agent on the sleeve 4a, which has passed through the development section c, successively enters the developing agent accommodation unit 4h as the sleeve 4a rotates. Then, the thin layer of the developing agent is separated from the sleeve 4a by the repelling magnetic field of a transportation pole and returned into the developing agent reservoir in the developing agent accommodation unit 4h.

A DC voltage and an AC voltage are applied to the sleeve 4a from an unillustrated power supply. In this embodiment, a DC voltage of −500V and an AC voltage having a frequency of 2000 Hz and a peak to peak voltage of 1500V are applied to the sleeve 4a, and only the exposure area exposed by the exposure section "b" of the photosensitive drum 2 is selectively developed.

In general, in the two-component developing method, the development efficiency is increased and the quality of an image is enhanced by the application of the AC voltage. However, there is a danger that fog is liable to occur. To cope with this problem, fog is ordinarily prevented by providing a potential difference between the DC voltage applied to the sleeve 4a and the surface potential of the photosensitive drum 2. More specifically, a bias voltage, which has a potential between the potential of the exposed area of the photosensitive drum 2 and the potential of the non-exposed area thereof, is applied.

When the toner is consumed by the development, the toner density in the developing agent is lowered. In this embodiment, a toner density sensor 4g is disposed at a position near to the outer peripheral surface of the stirring screw 4eB. When the sensor 4g detects that the toner density in the developing agent is lower than a predetermined density level, a command for replenishing the toner from the toner replenishing container 5 into the development device 4 is issued. The toner density in the developing agent is maintained and managed to the predetermined level at all times by the toner replenishing operation.

<Toner Replenishing Containers>

Toner replenishing containers 5Y, 5M, 5C, and 5K are disposed in parallel with each other above the cartridges 1Y, 1M, 1C, 1K and mounted from the front side of the apparatus body 100.

As shown in FIG. 2, a stirring plate 5b fixed to a stirring shaft 5c and a screw 5a are disposed in the toner replenishing container 5, and a discharge opening 5f is formed on the bottom of the container to discharge the toner.

Each of the screw 5a and the stirring shaft 5c is rotatably supported by bearings at both the ends thereof, and a recessed drive coupling (not shown) is disposed at one extreme end thereof. The recessed drive coupling is rotated by a driving force transmitted from the projecting drive coupling (not shown) of the apparatus body 100.

The screw 5a is formed in a spiral rib shape and inverted in a spirally twisted direction about the discharge opening 5f. The screw 5a is rotated in a predetermined direction by the rotation of the projecting drive coupling.

Then, the toner is transported toward the discharge opening 5f by the rotation of the screw 5a, freely dropped from the discharge opening 5f, and replenished to the development device 4 of the process cartridge 1.

The stirring plate 5b inclines at the extreme end thereof in a rotational radius direction, and when the stirring plate 5b comes into sliding contact with the wall surface of the toner replenishing container 5, the extreme end of the stirring plate 5b is in contact with the wall surface at a certain angle. More specifically, the extreme end side of the stirring plate 5b is twisted and made to a spiral shape. As described above, since the extreme end of the stirring plate 5b is twisted and inclines, a force for transporting the toner in an axial direction is generated, thereby transporting the toner in the lengthwise direction.

It should be noted that the toner replenishing container 5 of this embodiment can replenish toner to a process cartridge or a development cartridge employing a one-component development method, in addition to the process cartridge employing the two-component development method. Further, it is needless to say that the toner replenishing container 5 can replenish not only the toner but also a so-called developing agent in which toner and magnetic carriers are mixed.

<Transfer Means>

An intermediate transfer unit 54 acting as transfer means secondarily transfers a plurality of toner images, which are primarily transferred sequentially from the photosensitive drum 2 and overlapped with each other, onto the recording medium 52 at a time.

The intermediate transfer unit 54 has the intermediate transfer belt 54a traveling in the direction of the arrow adjacent the belt 54a in FIG. 2 and travels in the clockwise direction shown by the arrow at a peripheral speed approximating the outer peripheral speed of the photosensitive drum 2. The intermediate transfer belt 54a is composed of an endless belt having a peripheral length of about 940 mm and stretched around three rollers, i.e. a drive roller 54b, a secondary transfer facing roller 54g, and a follower roller 54c.

Further, transfer rollers 54fY, 54fM, 54fC, and 54fK to be charged are rotatably disposed at the positions facing the respective photosensitive drums 2 along the intermediate transfer belt 54a and pressed against the photosensitive drums 2 in the center direction thereof.

The transfer rollers 54*f*Y, 54*f*M, 54*f*C, and 54*f*K are energized by an unillustrated high voltage power supply, charged at a polarity opposite to that of the toner from the back side of the intermediate transfer belt 54*a*, and sequentially transfer the toner images on the photosensitive drums 2 onto the upper surface of the intermediate transfer belt 54*a*.

In a secondary transfer section, a secondary transfer roller 54*d* acting as a transfer member comes into pressure contact with the intermediate transfer belt 54*a* at the position at which it faces the secondary transfer facing roller 54*g*. The secondary transfer roller 54*d* can swing up and down as well as rotate in FIG. 1. At this time, since a bias is simultaneously applied to the intermediate transfer belt 54*a*, the toner images on the intermediate transfer belt 54*a* are transferred onto the recording medium 52.

The intermediate transfer belt 54*a* and the secondary transfer roller 54*d* are driven respectively.

When the recording medium 52 enters the secondary transfer section, a predetermined bias is applied to the secondary transfer roller 54*d*, thereby secondarily transferring the toner images on the intermediate transfer belt 54*a* onto the recording medium 52.

At this time, the recording medium 52 sandwiched between both the intermediate transfer belt 54*a* and the secondary transfer roller 54*d* is subjected to the transfer step and at the same time transported left in the figure at a predetermined speed toward the fixing means where a next step is executed.

A cleaning unit 55 is disposed at a predetermined position of the intermediate transfer belt 54*a* on the most downstream side of the transfer operation as to come into contact with and separate from the surface of the intermediate transfer belt 54*a* and removes the toner that remains on the surface after the secondary transfer.

A cleaning blade 55*a* is disposed in the unit 55 to remove the remaining toner. The unit 55 is attached so as to swing about an unillustrated center of rotation, and the blade 55*a* comes into pressure contact with the intermediate transfer belt 54*a* in such a direction that it bites into the belt 54*a*. The remaining toner captured into the unit 55 is transported into a waste toner tank (not shown) by a feed screw and stored therein.

<Fixing Means>

The toner images formed on the photosensitive drums 2 by the development means are transferred onto the recording medium 52 through the intermediate transfer belt 54*a*. A fixing device 56 acting as the fixing means fixes the toner image transferred onto the recording medium 52 thereon using heat.

As shown in FIG. 1, the fixing device 56 includes a fixing roller 56*a* for applying heat to the recording medium 52 and a pressure roller 56*b* for causing the recording medium 52 to come into pressure contact with the fixing roller 56*a*, and these rollers 56*a* and 56*b* are composed of hollow rollers having heaters (not shown) disposed therein. The rollers 56*a* and 56*b* are rotated so as to transport the recording medium 52.

More specifically, the recording medium 52, on which the toner image is held, is transported by the fixing roller 56*a* and the pressure roller 56*b* and the toner image is fixed on the recording medium 52 by the heat and pressure applied thereto.

The recording medium 52, on which the toner image has been fixed, is discharged by discharge rollers 53*h* and 53*j* and stacked on a tray 57 on the apparatus body 100.

<Mounting of Process Cartridges and Toner Replenishing Containers>

Next, procedures for mounting each of the cartridges 1Y, 1M, 1C, 1K (hereinafter, simply referred to as "cartridge 1") and each of the toner replenishing containers 5Y, 5M, 5C, 5K (hereinafter, simply referred to as "toner replenishing container 5") will be explained with reference to FIGS. 2 to 4.

Figure 3:
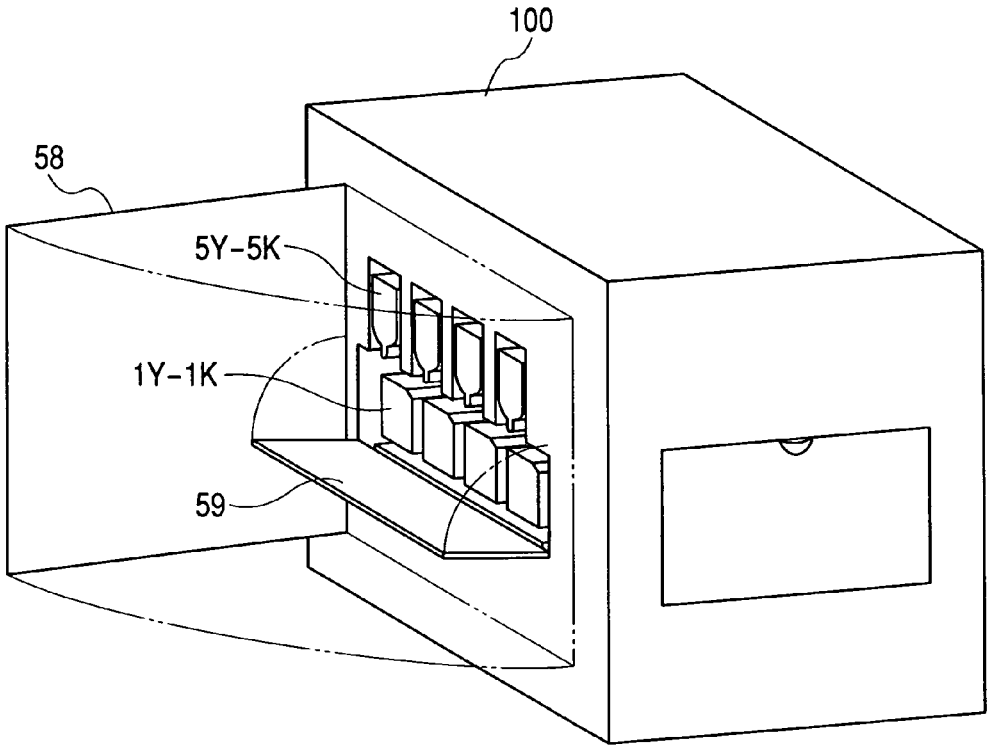
FIG. 3 is a perspective view schematically showing a state that a front door of the main body of the image forming apparatus according to the first embodiment is opened.

As shown in FIG. 3, an openable/closable front door 58 is disposed on the front surface of the apparatus body 100. When the front door 58 is opened outward, openings, through which the cartridge 1 and the toner replenishing container 5 are inserted, are exposed.

A swingably supported center determination plate 59 is disposed to cover and expose the openings through which the cartridge 1 is inserted, and the cartridge 1 is inserted and extracted after the center determination plate 59 is opened.

As shown in FIG. 2, a guide rail 60 for guiding the cartridge 1 and a guide rail 61 for guiding the toner replenishing container 5 are fixed in the apparatus body 100 to guide them when they are mounted.

The cartridge 1 and the toner replenishing container 5 are mounted in a direction parallel with the axial direction of the photosensitive drum 2, and the guide rails 60 and 61 are disposed also in this direction. The cartridge 1 and the toner replenishing container 5 are slidingly inserted from the front side into the back side of the apparatus body 100 along the guide rails 60 and 61 once.

When the cartridge 1 is inserted to the innermost portion of the apparatus body 100, the centering shafts of the apparatus body 100 are inserted into the center holes 2*f* of the drum flanges 2*b*, thereby determining the positions of the center of rotation of the photosensitive drums 2 on the back side thereof with respect to the apparatus body 100.

At the same time, driving force transmitting portions 2*g* formed to the drum flanges 2*b* are coupled with projecting drum couplings 62*a*, thereby providing a mechanism for rotating the photosensitive drums 2. The driving force transmitting portion 2*g* used in this embodiment is formed in a twisted triangular prism shape, and by applying a driving force thereto from the apparatus body 100, a driving force is transmitted to the driving force transmitting portion 2*g* and also a force for pulling the photosensitive drums 2 into the back side is generated.

Further, support pins 63 are disposed on a rear side plate 65 to position the cartridge 1, and the positions of the frames of the cartridge 1 are fixed by the support pins 63 inserted thereinto.

The swingable center determination plate 59 is disposed on the front side of the apparatus body 100. The bearing cases 2*c* of the cartridges 1 are supported by and fixed to the center determination plate 59. The cartridge 1 including the photosensitive drums 2 is positioned with respect to the apparatus body 100 by a series of insertion operations described above.

In contrast, when the toner replenishing containers 5 are inserted to the innermost portion of the apparatus body 100, they are fixed to support pins (not shown) projecting from the rear side plate 65. At the same time, recessed drive couplings (not shown) are coupled with projecting drive couplings (not shown), thereby providing a mechanism for rotating the screw 5*a* and the stirring shaft 5*c*.

<Method of Breaking Down and Reproducing Process Cartridge>

Next, a method of breaking down and refurbishing the process cartridge 1 applied to this embodiment will be explained.

Figure 5:
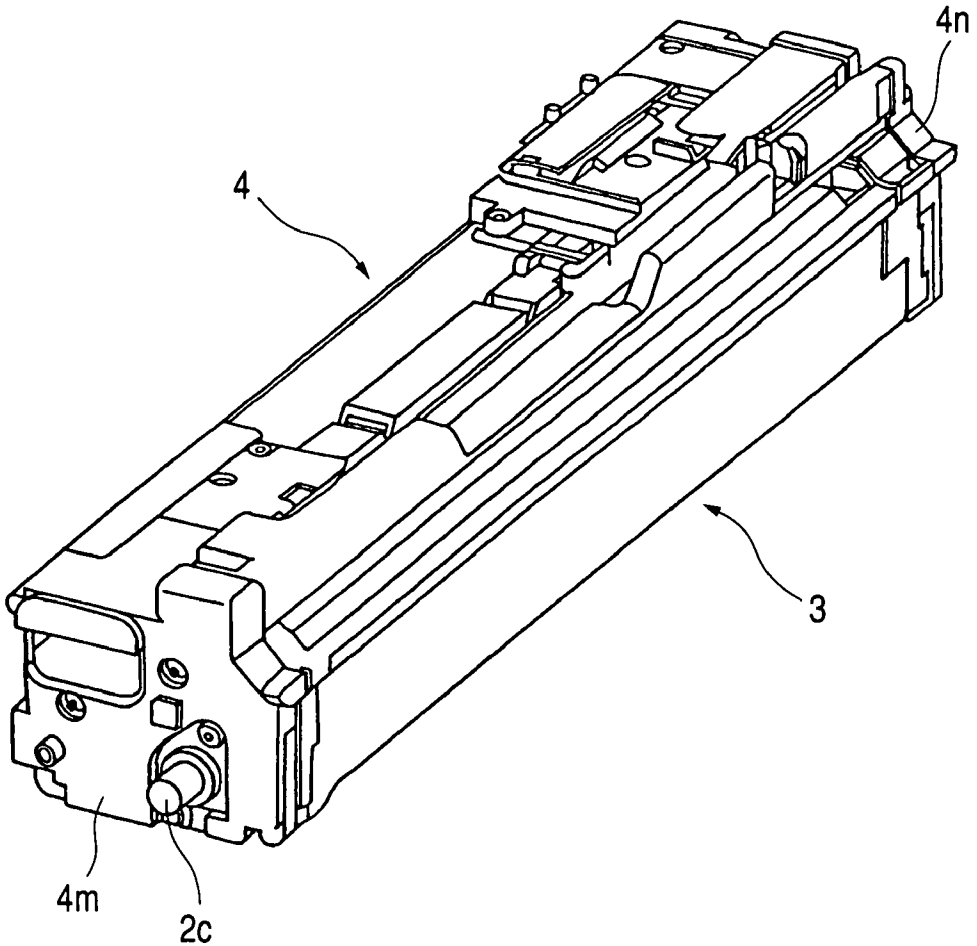
FIG. 5 is a perspective view schematically showing the process cartridge according to the first embodiment.

The cartridge 1 is arranged as shown in FIG. 5. More specifically, the cartridge 1 is detachably attachable to the apparatus body 100 and includes the photosensitive drum 2, a charging unit 3 having the charging roller 3*a* for charging the photosensitive drum 2, and the development device 4 as the development unit (development means) for developing a latent image on the photosensitive drum 2 using the development sleeve 4*a*, and the photosensitive drum 2 and charging unit 3 are attached to the development device 4.

<Method of Breaking Down Process Cartridge>

(Side Plate Removing Step)

Figure 6:
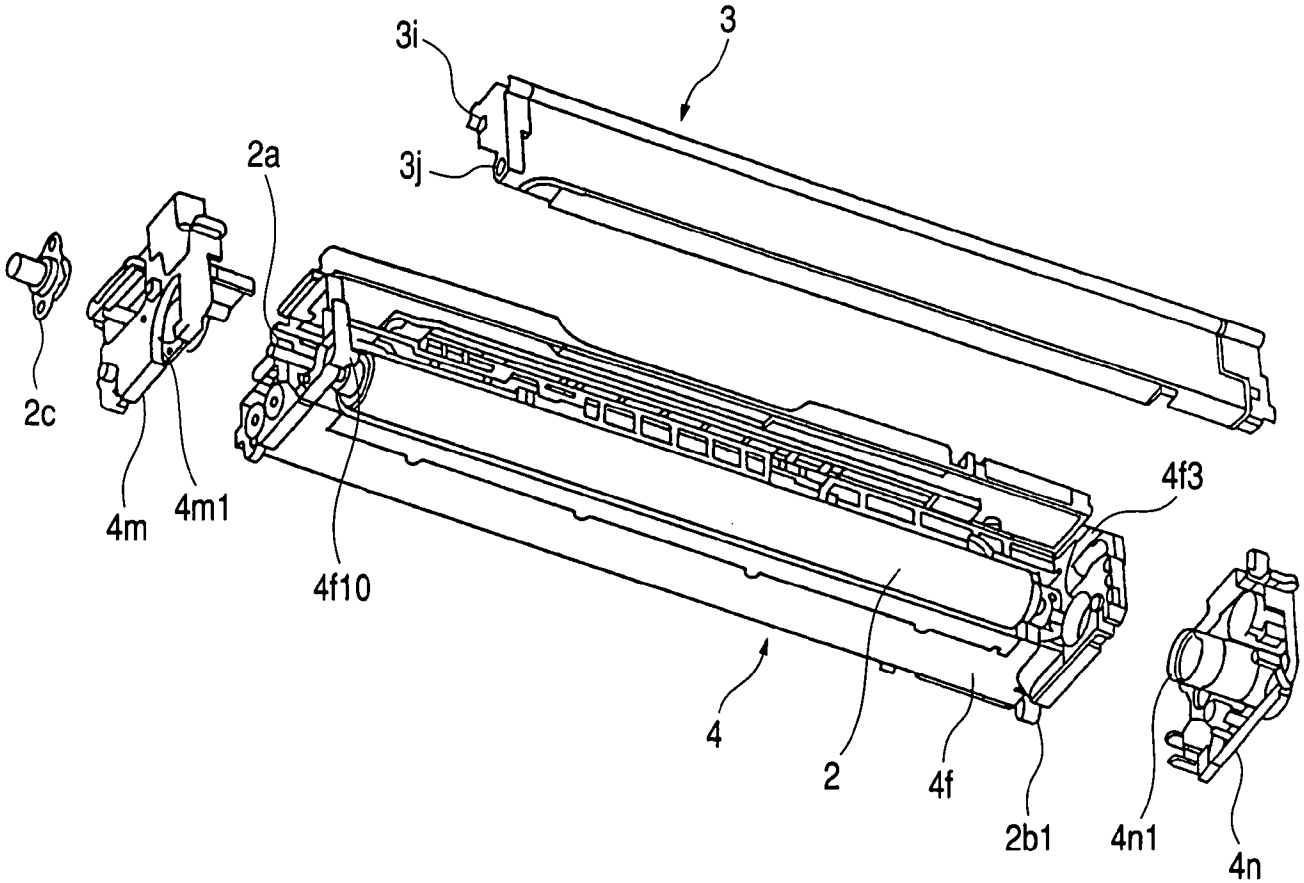
FIG. 6 is a perspective view showing the broken down state of the process cartridge according to the first embodiment.

As shown in FIG. 6, a side cover 4*n* (first side plate) on a drive side is removed by removing screws (not shown) coupling the development device 4 with the side cover 4*n* at an end of the cartridge 1 in the lengthwise direction thereof.

Likewise, a side cover 4*m* (second side plate) on a non-drive side is removed by removing screws (not shown) coupling the development device 4 with the side cover 4*m* and the bearing case 2*c* at the other end of the cartridge 1 in the lengthwise direction thereof.

Since the bearing case 2*c* has an engaging portion at which it is engaged with the hole 4*m*1 of the side cover 4*m*, it can be broken down likewise without being removed from the side cover 4*m*.

The order for removing the side covers 4*n* and 4*m* is not limited to the order described above.

(Charging Unit Removing Step)

When the side covers 4*n* and 4*m* at both the ends in the lengthwise direction are removed, the photosensitive drum 2 and the charging unit 3 are placed in the state that they are supported by the development device 4. At this time, the development device 4 is supported in a stable attitude by disposing the density sensor 4*g* at a lower position, thereby permitting the charging unit 3 to be easily removed. At the time, the photosensitive drum 2 is roughly positioned with respect to the development device 4 in the lengthwise direction and a radial direction in the state that it is placed on the spacer 4*k* acting as a gap guarantee member, a development frame 4*f* for supporting the development sleeve 4*a*, and bearing members 4*i* for rotatably supporting the development sleeve 4*a*. FIG. 6 shows the state of the charging unit broken down in the above step.

(Photosensitive Drum Removing Step)

Figure 7:
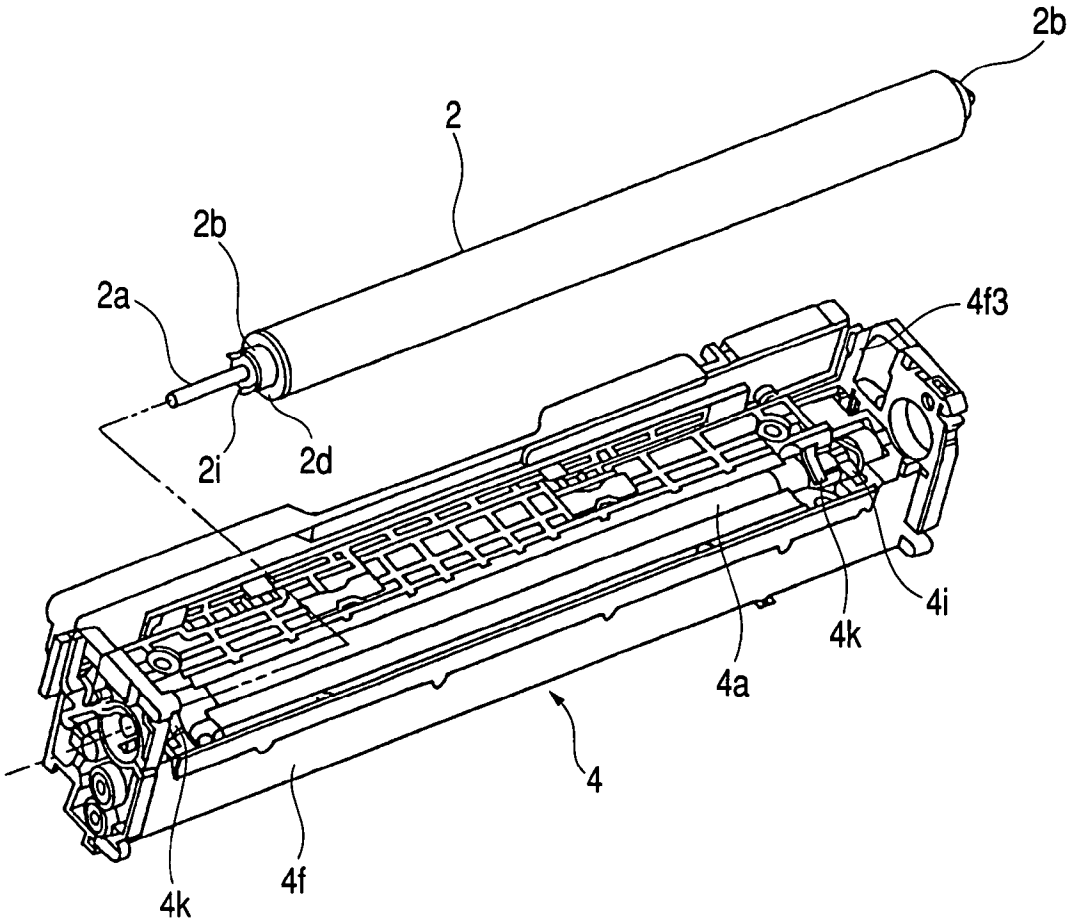
FIG. 7 is a perspective view showing a step of removing a photosensitive drum unit from a development device according to the first embodiment.

The photosensitive drum 2 is supported by the development device 4 at an end thereof on the non-drive side through the drum shaft 2*a* coaxial with the photosensitive drum 2. Accordingly, when the photosensitive drum 2 is thrust moved in the direction of the drive side, it is removed together with the unit including the drum shaft 2*a* as shown in FIG. 7.

Next, the photosensitive drum 2 and load generation means 21 can be independently broken down by extracting the drum shaft 2*a* from the photosensitive drum 2.

Further, as a second method, it is also possible to take out the photosensitive drum 2 in a direction across the lengthwise direction by simply placing the photosensitive drum 2 on the development device 4 by thrust-moving only the drum shaft 2*a* to the non-drive side and extracting it to the outside of the development device 4 while pressing the photosensitive drum 2 attached to the development device 4.

<Method of Reassembling Process Cartridge>

(Replacement with New Photosensitive Drum)

The drum shaft 2*a* is inserted into a new photosensitive drum 2, and the D-cut portion of a drum flange 2*b* is engaged with the D-cut portion 2*a*1 of the drum shaft 2*a*. Next, the load generation means 21 is fitted into the hole of a non-drive side flange 2*d* through the drum shaft 2*a* (refer to FIG. 8).

Further, the load generation means 21 may be previously attached to the photosensitive drum 2, and then the drum shaft 2*a* may be inserted into the photosensitive drum 2.

At this time, when a torque limiter 2*h*, which is a part of the load generation means 21, is caught while it is rotated, or does not adequately perform, a step of replacing the torque limiter 2*h* with a new one is added. However, it is needless to say that the torque limiter 2*h* may be replaced even if it is not caught, and the like.

Further, when the photosensitive drum 2 is replaced together with the drum shaft 2*a*, the drum shaft 2*a* need not be extracted from and inserted into the photosensitive drum 2.

(Photosensitive Drum Attaching Step)

The drum shaft 2*a*, which is inserted into the new photosensitive drum 2, is inserted into the through hole of the development device 4. Then, the taper portion 2*i* of the load generation means 21 at an extreme end thereof is moved to the vicinity of a side surface of the development device 4 together with the photosensitive drum 2 (refer to FIG. 7). At this time, it is preferable that the development device 4 be kept in such an attitude that the density sensor 4*g* is disposed at a lower position similarly to the case when the development device 4 is broken down. At the time, the photosensitive drum 2 is roughly positioned with respect to the development device 4 in the lengthwise direction and the radial direction in the state that it is placed on the spacer 4*k* acting as the interval guarantee member, the development frame 4*f* for supporting the development sleeve 4*a*, and the bearing members 4*i* for rotatably supporting the development sleeve 4*a*.

(Charging Unit Reproducing Step)

The remaining toner uniforming means 3*g* and the toner charge control means 3*h*, which act as a brush member in the charging unit 3, are under the state that remaining toner and retransferred toner are captured. Thus, a step of cleaning the bush member is executed before the cleaning unit is refurbished. Further, when the brush member and the charging roller 3*a* are greatly damaged in their functions, they may be replaced with new ones.

(Charging Unit Attaching Step)

After the photosensitive drum 2 is attached to the development device 4, the cleaned charging unit 3 is attached to the development device 4 along assembly guides 4*f*3 and 4*f*10 (refer to FIG. 6). At this time, the charging roller 3*a* and the brush member are in contact with the photosensitive drum 2.

Figure 10:
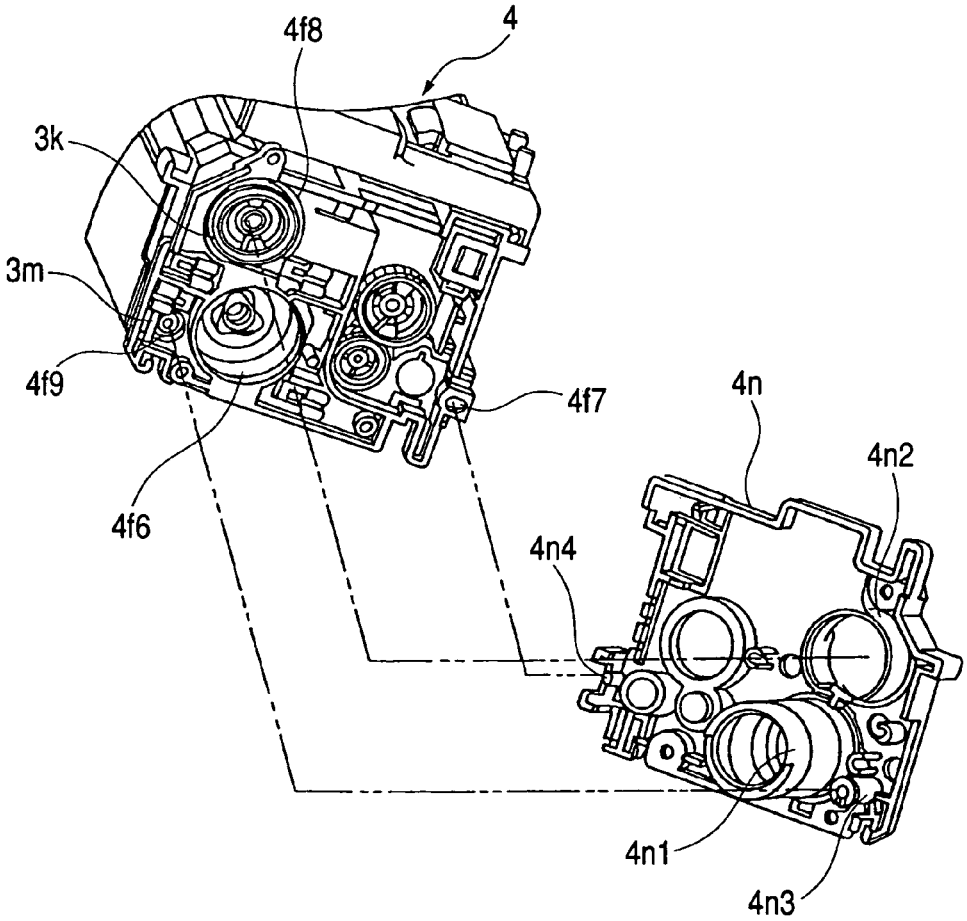
FIG. 10 is a perspective view showing a step of attaching a first side plate according to the first embodiment.
Figure 11:
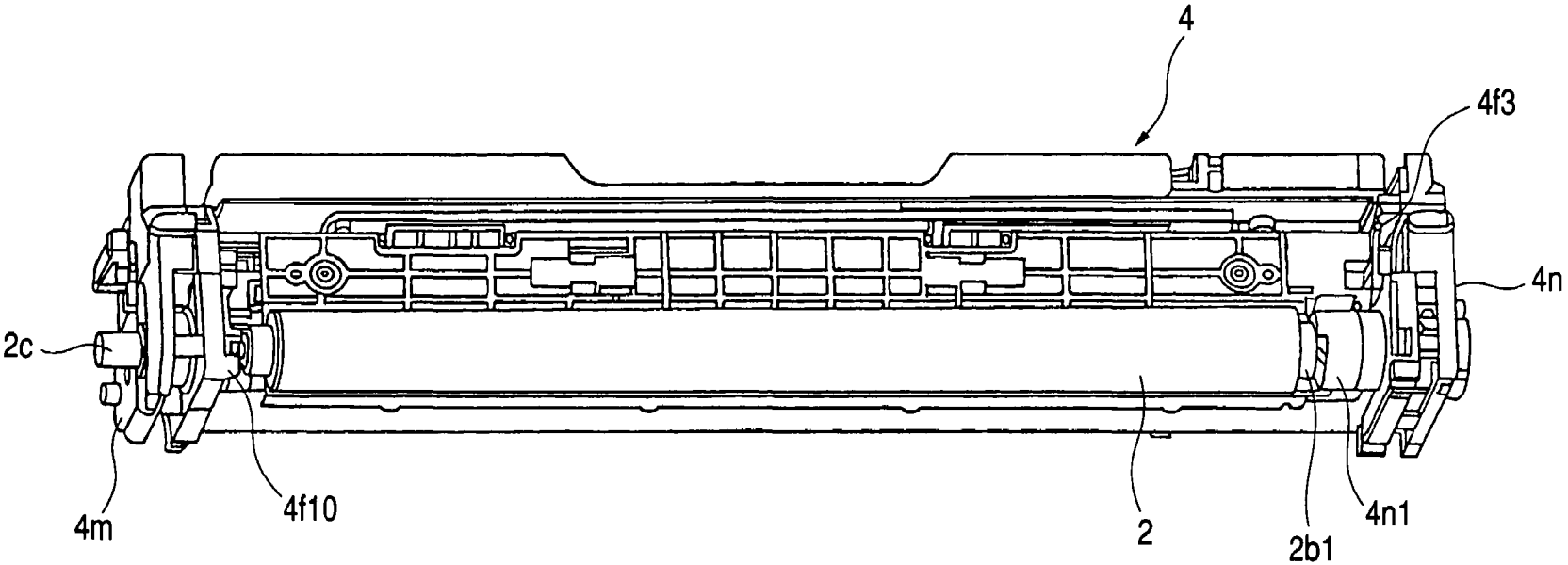
FIG. 11 is a perspective view showing a state that the photosensitive drum unit is tentatively fixed to the development device according to the first embodiment.

Further, as shown in FIG. 11, it is also possible to attach the charging unit 3 in the state that the photosensitive drum 2 is tentatively fixed by attaching the side cover 4*n* acting as the first side plate on the drive side up to a midpoint of the development device 4. The midpoint described here means the position to which a cylindrical portion 4*n*1 is inserted to such a degree that the extreme end of a cylindrical portion 4*n*2 for positioning the charging unit 3 shown in FIG. 10 is not caught by the assembly guide 4*f*3. Further, the midpoint is the position at which the extreme end of the cylindrical portion 4n1 of the side cover 4n on the drive side reaches the vicinity of the end surface of the drum flange and overlaps the end surface of a flange cylindrical portion 2b1. With the above arrangement, the movement of the photosensitive drum 2 is regulated in the lengthwise direction and the radial direction.

(Memory Element Replacing Step)

Figure 12:
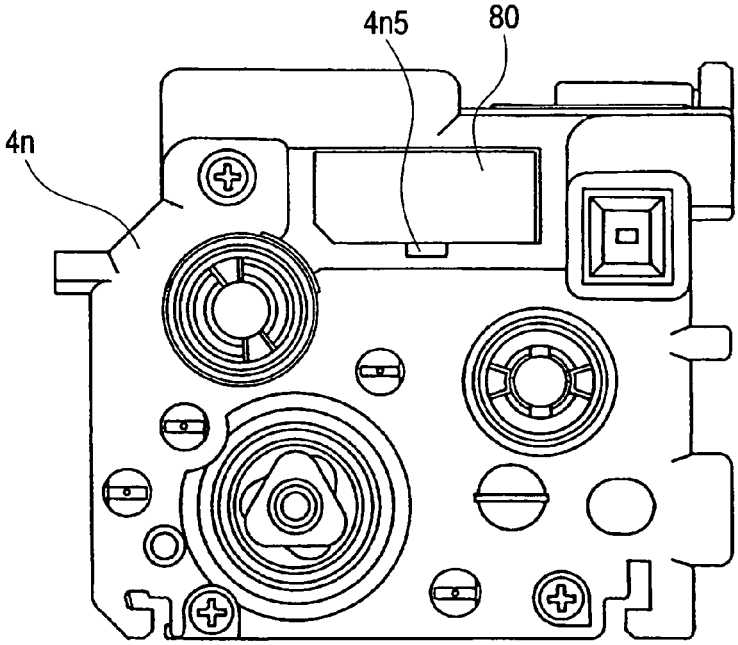
FIG. 12 is a front elevational view showing the process cartridge according to the first embodiment when it is viewed from a drive side.

A memory unit 80 acting as a memory element, attached to the side cover 4n shown in FIG. 12 acting as the first side plate on the drive side, can be easily removed by inserting a tool (driver, and the like) into the cutout 4n5 of the side cover 4n.

Next, another memory unit having new information such as information in a fresh state or reproduction information or the same memory unit whose information is rewritten is attached to a predetermined position.

Note that although a double-faced tape is used in this embodiment as attachment means for attaching the memory unit 80, any means may be used as long as it can bond and fix the memory unit 80.

(Side Plate Attaching Step)

After the charging unit 3 and the photosensitive drum 2 are attached to the development device 4 at the predetermined positions thereof as described above, a step of determining the relative position between the charging unit 3 and the photosensitive drum 2 using the first and second side plates will be executed.

Figure 9:
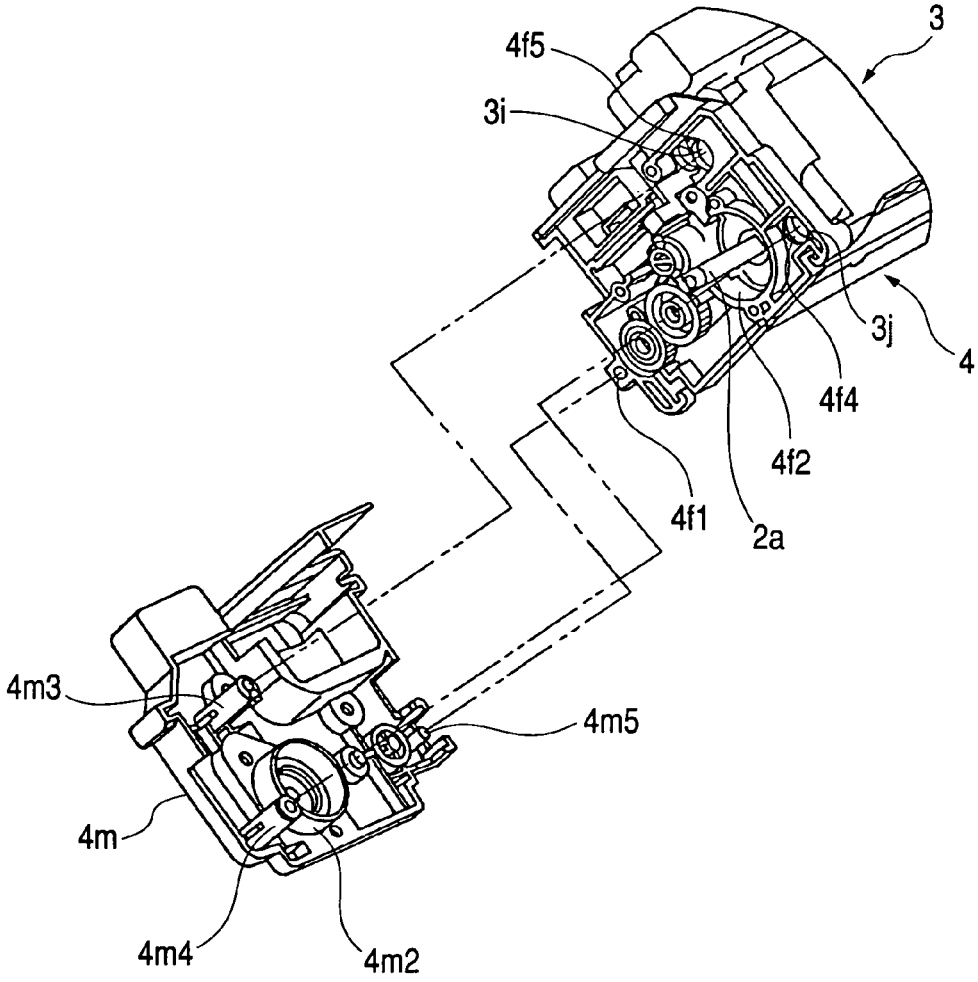
FIG. 9 is a perspective view showing a step of attaching a second side plate according to the first embodiment.

In the side cover 4m acting as the second side cover on the non-drive side, a drum coaxial cylindrical portion 4m2 is fitted into the cylindrical groove 4f2 of the development frame 4f, and a side cover swing prevention boss 4m5 is fitted into a slot 4f1 as shown in FIG. 9. With the above arrangement, the position of the photosensitive drum 2 on the non-drive side is determined with respect to the development device 4.

At this time, the bearing case 2c is engaged with the hole 4m1 of the side cover 4m. Further, the bearing case 2c may be attached along the drum shaft 2a after the side cover 4m is attached to the development device 4.

Further, a charging unit positioning boss 4m3 passes through a U-shaped hole 4f5 and is fitted into a positioning hole 3i. Furthermore, a charging unit swing prevention boss 4m4 passes through a hole 4f4 and is fitted into a slot 3j. With the above arrangement, the position of the charging unit 3 on the non-drive side is determined with respect to the development device 4.

Next, in the side cover 4n acting as the first side plate on the drive side, a cylindrical portion 4n1 is fitted into a drum coaxial hole 4f6 of the development frame 4f, and a side cover swing prevention boss 4n4 is fitted into a slot 4f7 as shown in FIG. 10. With the above arrangement, the final position of the photosensitive drum 2 is determined with respect to the development device 4.

At this time, since a gap is formed between the inside diameter of the cylindrical portion 4n1 and the outside diameter of the cylindrical portion 2b1 of the drum flange 2b, the photosensitive drum 2 can be moved only by a small amount in a direction perpendicular to the lengthwise direction.

Further, the cylindrical portion 4n2 passes through a hole 4f8 and is engaged with a cylindrical positioning portion 3k. Then, the cylindrical portion 4n2 passes through a charging unit swing prevention boss 4n3 and a hole 4f9 and is fitted into a slot 3m. With the above arrangement, the final position of the charging unit 3 is determined with respect to the development device 4.

Note that either the step for attaching the side cover 4n (first side plate) or the step for attaching the side cover 4m (second side cover) may be executed first.

After the side covers 4n and 4m are attached, respectively, refurbishment, in which the photosensitive drum 2 is replaced, is finished by fixing the side plates to the development device 4 using screws.

Although the method of fixing the side plates to the development device 4 using the screws has been explained in the refurbishing method of this embodiment, any of methods such as welding, caulking, and the like may be used as long as it can fix a plurality of parts.

Note that the respective steps in the refurbishing method of this embodiment need not be executed in the order of the steps described above, and the order of the steps may be appropriately changed when it is possible.

Further, in the embodiment described above, there is included the case that a used process cartridge is collected and broken down, the same parts taken out from the broken-down process cartridge are grouped, and then a process cartridge is refurbished by the refurbishing method described above using the parts taken out from the used process cartridge, partly using new parts (which are not reused) when necessary, and further using parts taken out from another process cartridge.

(Second Embodiment)

Next, a second embodiment of the present invention will be explained. Since the second embodiment is the same as the first embodiment except a breaking down and refurbishing method of the process cartridge, the same components as those used in the first embodiment are denoted by the same reference numerals and the explanation thereof omitted.

<Method of Breaking Down and Refurbishing Process Cartridge>

Next, a method of breaking down and refurbishing a process cartridge 1 applied to the embodiment will be explained.

The process cartridge 1 is arranged as shown in FIG. 5 similarly to the first embodiment. The process cartridge 1 is detachably attachable to an apparatus body 100 and includes a photosensitive drum 2, a charging unit 3 having a charging roller 3a for charging the photosensitive drum 2, and a development device 4 (development means) acting as a development unit for developing a latent image on the photosensitive drum 2 using a sleeve 4a, and the photosensitive drum 2 and the charging unit 3a are attached to the development device 4.

<Method of Breaking Down Process Cartridge>

(Side Plate Removing Step)

As shown in FIG. 6, a side cover 4n (first side plate) on a drive side is removed from the development device 4 by removing screws (not shown) that couples the development device 4 with the side cover 4n at an end of the process cartridge 1 in a lengthwise direction thereof.

Likewise, a side cover 4m (second side plate) is removed from the development device 4 by removing screws (not shown) that couples the development device 4 with the side cover 4m and a bearing case 2c at the other end of the process cartridge 1 in the lengthwise direction thereof.

Since the bearing case 2c has a portion engaged with the hole 4ml of the side cover 4m, it can be broken down likewise without being removed from the side cover 4m.

Further, the order for removing the side covers 4n and 4m is not restricted to that discussed above.

(Charging Unit Removing Step)

When the side covers 4*n* and 4*m* are removed as described above, the photosensitive drum 2 and the charging unit 3 are in the state that it is supported by the development device 4. At this time, the development device 4 is supported in a stable attitude by disposing a density sensor 4*g* at a lower position, thereby permitting the charging unit 3 to be easily removed. At the time, the photosensitive drum 2 is roughly positioned with respect to the development device 4 in the lengthwise direction and a radial direction in the state that it is placed on a spacer 4*k* acting as a gap guarantee member, a development frame 4*f* for supporting the development sleeve 4*a*, and bearing members 4*i* for rotatably supporting the development sleeve 4*a*. FIG. 6 shows the state of the charging unit broken down according to the above steps.

(Photosensitive Drum Removing Step)

The photosensitive drum 2 is supported by the development device 4 at an end thereof on the non-drive side through a drum shaft 2*a* coaxial with the photosensitive drum 2. Accordingly, the photosensitive drum 2 is thrust-moved in the direction of the drive side so that it is removed together with the unit including the drum shaft 2*a* as shown in FIG. 7.

Figure 8:
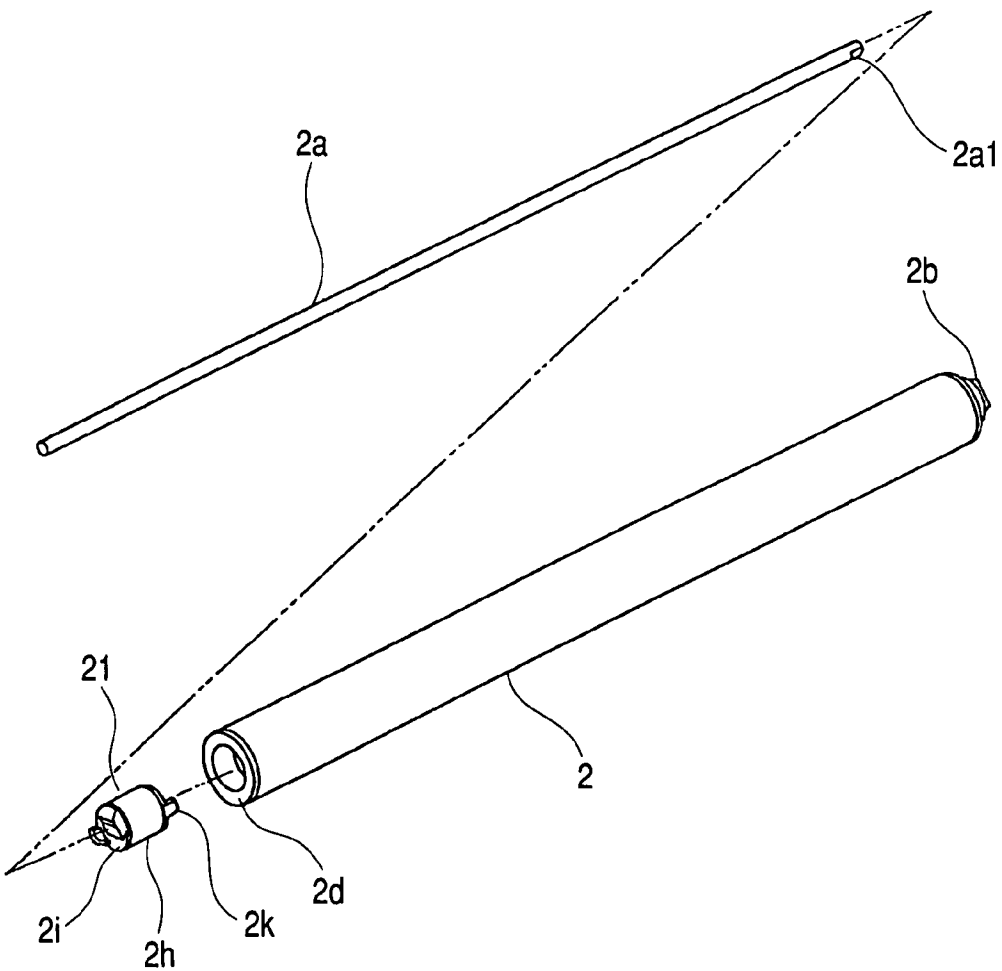
FIG. 8 is a perspective view showing a refurbishing step of the photosensitive drum unit according to the first embodiment.

Next, the photosensitive drum 2 and load generation means 21 can be independently broken down by extracting the drum shaft 2*a* from the photosensitive drum 2 as shown in FIG. 8.

Further, as a second method, only the drum shaft 2*a* is thrust-moved to the non-drive side and extracted to the outside of the development device 4 while pressing the photosensitive drum 2 attached to the development device 4. With this operation, it is also possible to take out the photosensitive drum 2 in a direction across the lengthwise direction because the photosensitive drum 2 is simply placed on the development device 4.

(Cover Member Removing Step)

Figure 13:
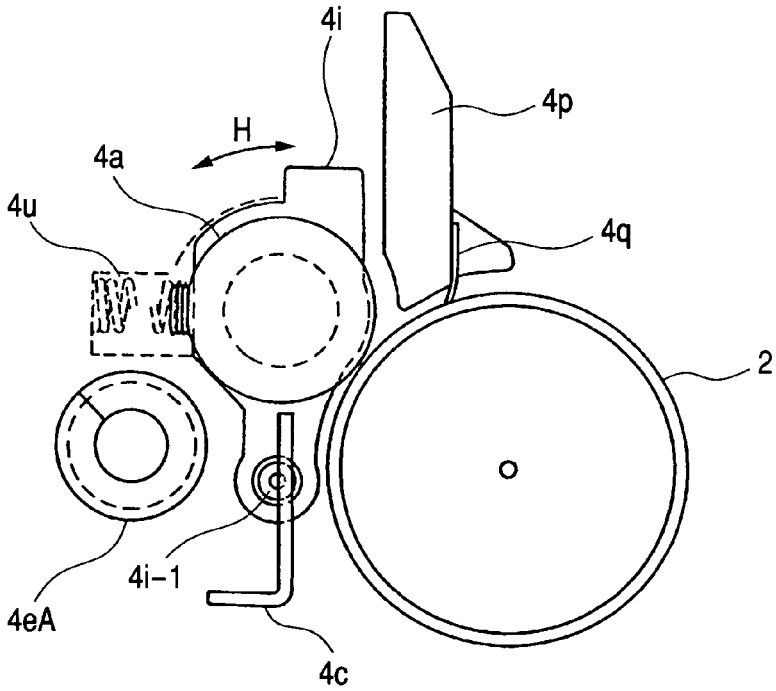
FIG. 13 is a schematic sectional view showing a state that a development sleeve according to a second embodiment is supported.

As shown in FIG. 2, a developing agent sealed in a developing agent accommodation unit 4*h* is stirred with stirring screws 4*e*A and 4*e*B and supplied to the development sleeve 4*a*. As shown in FIG. 13, the surface of the photosensitive drum 2, on which the developing agent is coated and which faces the photosensitive drum 2, is covered with (1) a cover member 4*p* acting as developing agent scattering prevention means and (2) a sheet member 4*q*, which is held by the cover member 4*p* and comes into contact with the photosensitive drum 2 in its overall area in the lengthwise direction, except for a development section c facing the photosensitive drum 2.

Thus, the cover member 4*p* is removed before the sleeve 4*a* is removed. At this time, screws (not shown), which fix the cover member 4*p* to a development frame 4*f*, must be removed.

(Pin Member Removing Step)

As shown in FIGS. 4 and 13, the development sleeve 4*a* has spacers 4*k* rotatably fitted on diameter-reduced journals 4*a*1 at both ends thereof. Then, bearing members 4*i* are urged in the direction of the photosensitive drum 2 by a presser spring 4*u*, thereby positioning the photosensitive drum 2 by the spacers 4*k* coming into contact therewith.

Figure 14:
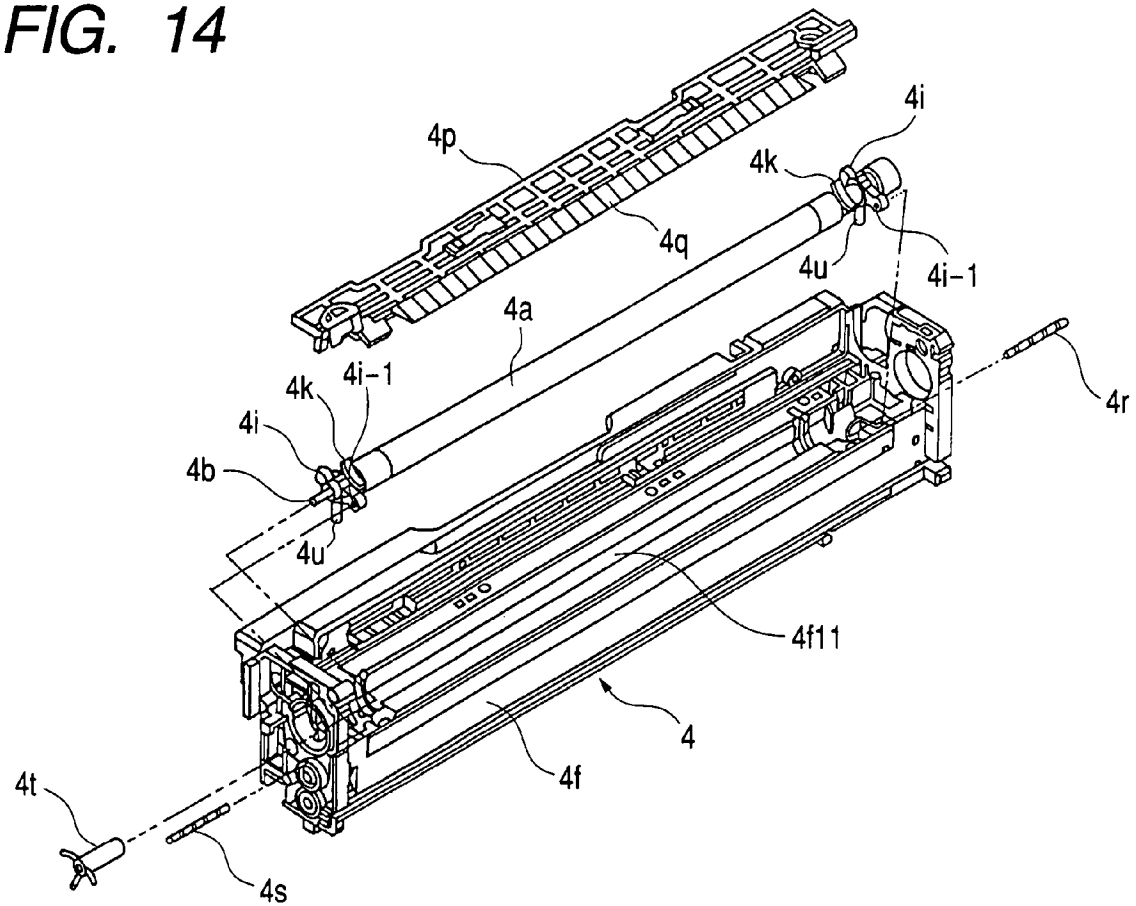
FIG. 14 is a perspective view showing a state that the development sleeve is removed from a development frame according to the second embodiment.

At the time, as shown in FIG. 14, the development sleeve 4*a* is supported by a development frame 4*f* so as to rotate with respect to the photosensitive drum 2 about the centers of rotation 4*i*-1 at both the ends of the bearing members 4*i*, where the centers of rotation 4*i*-1 are positioned by first and second pin members 4*r* and 4*s*.

With the above arrangement, the sleeve 4*a* fixed to the development frame 4*f* can be removed therefrom by removing the first and second pin members 4*r* and 4*s* from the development frame 4*f*.

(Regulation Member Removing Step)

A magnet roller 4*b* included in the sleeve 4*a* has magnetic poles disposed in a peripheral direction to supply the developing agent to the photosensitive drum 2 and to transport the developing agent to a regulation blade 4*c*.

A regulation member 4*t* shown in FIG. 14 is used to regulate and fix the rotation of the magnet roller 4*b* so that the position, at which the magnetic poles of the magnet roller 4*b* are disposed, faces the photosensitive drum 2 and the regulation blade 4*c* at all times.

The regulation member 4*t* is coupled with the magnet roller 4*b* so as to fix the rotation thereof. Further, since the regulation member 4*t* is coupled with the development frame 4*f* so as to fix the rotation thereof, the rotating direction of the magnet roller 4*b* is fixed with respect to the development frame 4*f*.

Thus, the magnet roller 4*b* fixed to the development frame 4*f* is removed therefrom by removing the regulation member 4*t* from the development frame 4*f* as shown in FIG. 14.

Even if the order of the cover member removing step, the pin member removing step, and the regulation member removing step is changed, these members can be broken down without any problem.

(Development Sleeve Removing Step)

As shown in FIG. 14, the sleeve 4*a* can be removed from the development frame 4*f* by removing the cover member 4*p*, the first and second pin members 4*r* and 4*s*, and the regulation member 4*t*.

In the above step, the development device 4 is kept in such an attitude that the development sleeve 4*a* can be removed from the development frame 4*f* upward. With the above arrangement, when the development sleeve 4*a* is removed from the development frame 4*f*, the opening 4*f*11 of the developing agent accommodation unit 4*h* faces upward, which prevents the leakage of the developing agent in the developing agent accommodation unit 4*h*.

The process cartridge 1 in this embodiment is formed in a shape capable of keeping the above attitude.

(Process for Cleaning Developing Agent in Developing Agent Accommodation Unit)

As shown in FIG. 14, when the development sleeve 4*a* is removed from the development frame 4*f*, the opening 4*f*11 of the developing agent accommodation unit 4*h*, which supplies the developing agent to the sleeve 4*a*, appears in the development frame 4*f*. Accordingly, it is possible to evacuate a used developing agent from the opening 4*f*11.

(Development Sleeve Cleaning Step)

The developing agent is deposited on the development sleeve 4*a* removed from the development frame 4*f* by the magnetic action of the magnet roller 4*b* in the development sleeve 4*a*. The development sleeve 4*a* can be reused by removing the deposited developing agent therefrom.

Note that when a new development sleeve 4*a* is used, the cleaning step is not necessary.

(Development Sleeve Attaching Step)

A cleaned or new development sleeve 4*a* is attached to the development frame 4*f* (refer to FIG. 14).

(Cover Member Attaching Step)

The cover member 4*p* is attached to the surface of the development sleeve 4*a* facing the photosensitive drum 2 as the developing agent scattering prevention means.

At this time, the screws (not shown) must be attached to fix the cover member 4*p* to the development frame 4*f*.

(Pin Member Attaching Step)

The first and second pin members 4*r* and 4*s*, which position the development sleeve 4*a* at the centers of rotation 4*i*-1 formed to the bearing members 4*i* at both the ends of the development sleeve 4*a*, are attached so that the bearing members 4*i* can be rotated with respect to the development frame 4*f*.

(Regulation Member Attaching Step)

The regulation member 4*t* is coupled with the magnet roller 4*b* so as to fix the rotation thereof and further coupled with the development frame 4*f* so as to fix the rotation of the regulation member 4*t*. Then, the regulation member 4*t* is attached so that the magnet roller 4*b* is located at a predetermined rotational position with respect to the development frame 4*f*.

<Method of Reassembling Process Cartridge>

(Replacement with New Photosensitive Drum)

The drum shaft 2*a* is inserted into a new photosensitive drum 2 and the D-cut portion (not shown) of a drum flange 2*b* is engaged with the D-cut portion 2*a*1 of the drum shaft 2*a*. Next, the load generation means 21 is fitted into the hole of a flange 2*d* on a non-drive side (refer to FIG. 8).

Further, the load generation means 21 may be previously attached to the photosensitive drum 2, and then the drum shaft 2*a* may be inserted into the photosensitive drum 2.

At this time, when a torque limiter 2*h*, which is a part of the load generation means 21, is caught while it is rotated or does not exhibit satisfactory performance, a step of replacing the torque limiter 2*h* with a new one is added. However, it is needless to say that the torque limiter 2*h* may be replaced even if it is not caught, and the like.

Further, when the photosensitive drum 2 is replaced together with the drum shaft 2*a*, the drum shaft 2*a* need not be extracted from and inserted into the photosensitive drum 2.

(Photosensitive Drum Attaching Step)

The drum shaft 2*a*, which is inserted into the photosensitive drum 2, is inserted into the through hole of the development device 4, and the tapered portion 2*i* of the load generation means 21 at the extreme end thereof is moved to the vicinity of a side surface of the development device 4 together with the photosensitive drum 2 (refer to FIG. 7). At this time, it is preferable that the development device 4 be kept in such an attitude that the density sensor 4*g* is disposed at a lower position similarly to the case that the developing device 4 is broken down. At the time, the photosensitive drum 2 is roughly positioned with respect to the development device 4 in the lengthwise direction and the radial direction in a state that it is placed on the spacer 4*k* acting as the gap guarantee member, a development frame 4*f* for supporting the development sleeve 4*a*, and the bearing members 4*i* for rotatably supporting the development sleeve 4*a*.

(Charging Unit Reproducing Step)

The remaining toner uniforming means 3*g* and the toner charge control means 3*h*, which act as a brush member in the charging unit 3, have captured remaining toner and retransferred toner. Thus, a step of cleaning the bush member is executed before the cleaning unit is reproduced. Further, when the brush member and the charging roller 3*a* are greatly damaged in their functions, they may be replaced with new ones.

(Charging Unit Attaching Step)

After the photosensitive drum 2 is attached to the development device 4, the cleaned charging unit 3 is attached to the development device 4 along assembly guides 4*f*3 and 4*f*10 (refer to FIG. 6). At this time, the charging roller 3*a* and the brush member are in contact with the photosensitive drum 2.

Further, as shown in FIG. 11, it is also possible to attach the charging unit 3 in a state that the photosensitive drum 2 is tentatively fixed by attaching the side cover 4*n* acting as the first side plate on the drive side up to a midpoint of the development device 4. The midpoint described here means the position to which a cylindrical portion 4*n*1 is inserted to such a degree that the extreme end of a cylindrical portion 4*n*2 for positioning the charging unit 3 shown in FIG. 10 is not caught by the assembly guide 4*f*3. Further, the midpoint is the position at which the extreme end of the cylindrical portion 4*n*1 of the side cover 4*n* on the drive side reaches the vicinity of the end surface of the drum flange and overlaps the end surface of a drum flange cylindrical portion 2*b*1. With the above arrangement, the movement of the photosensitive drum 2 is regulated in the lengthwise direction and the radial direction.

(Memory Element Replacing Step)

A memory unit 80 acting as a memory element, which is attached to the side cover 4*n* acting as the first side plate on the drive side, can be easily removed by inserting a tool (driver, and the like) into the cutout 4*n*5 of the side cover 4*n*.

Next, a new memory unit having the information of a fresh state is attached to a predetermined position.

Note that although a double-faced tape is used in this embodiment as attachment means for attaching the memory unit 80, any means may be used as long as it can bond and fix the memory unit 80 (refer to FIG. 12).

(Side Plate Attaching Step)

After the charging unit 3 and the photosensitive drum 2 are attached to the development device 4 at the predetermined positions thereof as described above, a step of determining the relative position between the charging unit 3 and the photosensitive drum 2 using the side covers 4*n* and 4*m* will be executed.

The position of the side cover 4*m* on the non-drive side of the photosensitive drum 2 is determined with respect to the development device 4 by fitting a drum coaxial cylindrical portion 4*m*2 into the cylindrical groove 4*f*2 of the development device and fitting a side cover swing prevention boss 4*m*5 into a slot 4*f*1.

At this time, the bearing case 2*c* is engaged with the hole 4*m*1 of the side cover 4*m*. Further, the bearing case 2*c* may be attached along the drum shaft 2*a* after the side cover 4*m* is attached to the development device 4.

Further, the charging unit positioning boss 4*m*3 passes through a U-shaped hole 4*f*5 and is fitted into a positioning hole 3*i*, and a charging unit swing prevention boss 4*m*4 passes though a hole 4*f*4 and is fitted into a slot 3*j*. With the above arrangement, the position of the charging unit 3 on the non-drive side is determined with respect to the development device 4 (refer to FIG. 9).

Next, the position of the photosensitive drum 2 is determined with respect to the development device 4 by fitting the cylindrical portion 4*n*1 of the side cover 4*n* into the drum coaxial hole 4f6 of the development frame 4f and fitting the side cover swing prevention boss 4n4 of the side cover 4n into a slot 4f7.

At this time, since a gap is formed between the inside diameter of the cylindrical portion 4n1 and the outside diameter of the cylindrical portion 2b1 of the drum flange 2b, the photosensitive drum 2 can be moved only by a small amount in a direction perpendicular to the lengthwise direction.

Further, the cylindrical portion 4n2 passes through a hole 4f8 and is engaged with a cylindrical positioning portion 3k. Then, the cylindrical portion 4n2 passes through a charging unit swing prevention boss 4n3 and a hole 4f9 and is fitted into a slot 3m. With the above arrangement, the final position of the charging unit 3 on the non-drive side is determined with respect to the development device 4 (refer to FIG. 10).

Further, the position of the photosensitive drum 2 can be tentatively fixed in a state that the cylindrical portion 4n1 passes through the drum coaxial hole 4f6 and the charging unit swing prevention boss 4n3 and the cylindrical portion 4n2 do not pass through the development frame 4f.

The side covers 4m and 4n are assembled from both the sides thereof after the photosensitive drum 2 and the charging unit 3 are placed on the development device 4, thereby determining the positions of the photosensitive drum 2 and the charging unit 3 with respect to the development device 4. Further, when the charging unit positioning boss 4m3 and the charging unit swing prevention boss 4m4 of the side cover 4m are assembled to the charging unit swing prevention boss 4n3 and the cylindrical portion 4n2 of the side cover 4n up to the positions at which they do not pass through the development frame 4f, the photosensitive drum 2 and the charging unit 3 can be placed on the development device 4.

Note that either the step of attaching the side covers 4m or the step of attaching the side cover 4n may be executed first.

After the side covers 4n and 4m are attached, respectively, refurbishing, in which the photosensitive drum 2 is replaced, is finished by fixing the side plates to the development device 4 using screws.

Although the method of fixing that uses the screws has been explained in the reproduction method of this embodiment, any of methods such as welding, caulking, and the like may be used as long as they can fix a plurality of parts.

Note that the respective steps in the refurbishing method of this embodiment need not be executed in the order of the steps described above, and the order of the steps may be appropriately changed when it is possible.

Further, the above embodiment can obtain the same effect by separately executing the following step, in an addition to the above steps.

(Developing Agent Evacuating Step)

Figure 15:
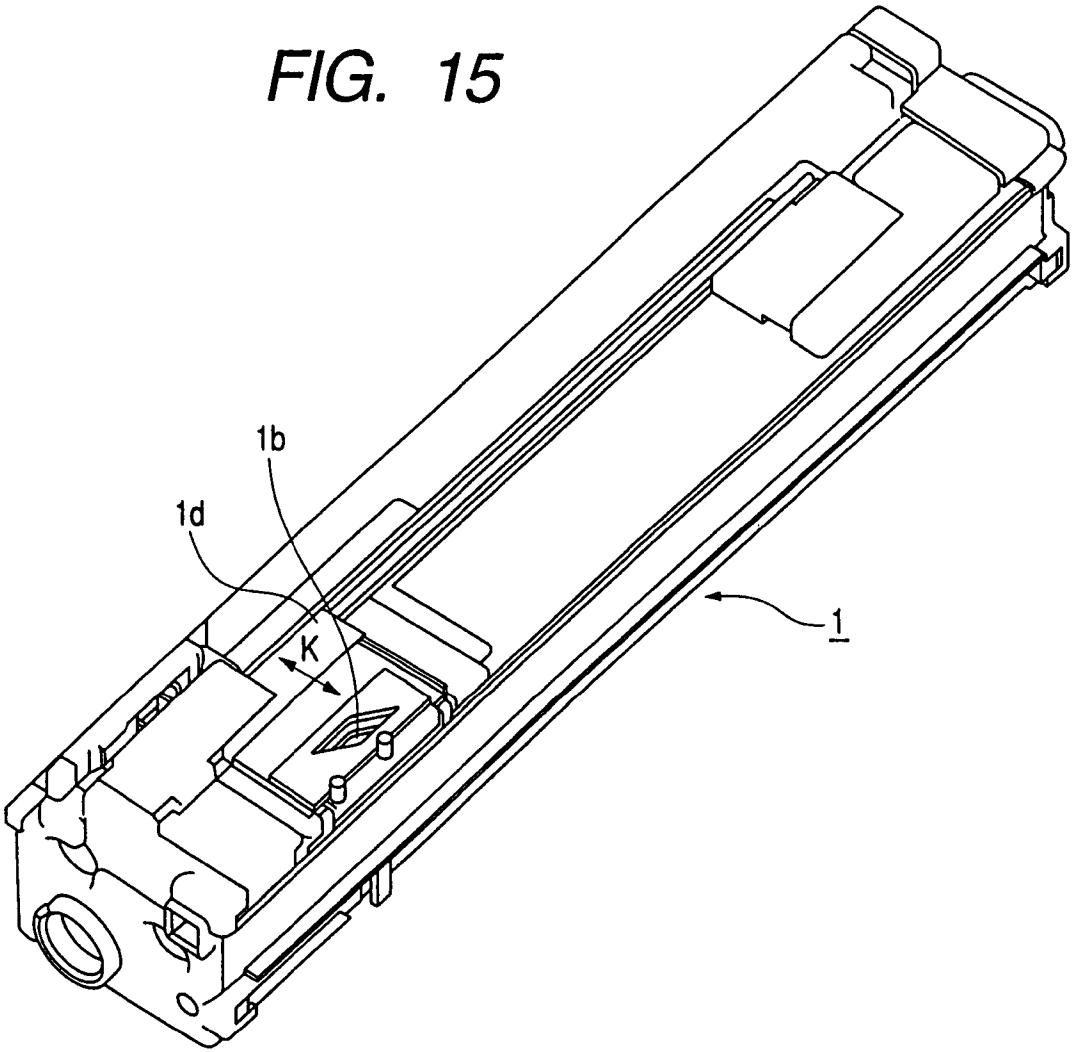
FIG. 15 is a perspective view showing a state that a developing agent replenishing port of the process cartridge according to the second embodiment is opened.

In the cartridge 1 which is replenished with the developing agent as in the above embodiment, it is also possible to evacuate the developing agent from a developing agent replenishing port 1b shown in FIG. 15, in addition to the method of removing the development sleeve 4a and evacuating the developing agent in the developing agent accommodation unit 4h in the above embodiment.

In this case, a replenishing port shutter 1d, which covers the developing agent replenishing port 1b and can be moved the direction of an arrow k, is set at a position at which the developing agent replenishing port 1b is opened (position shown in FIG. 14), thereby making it possible to evacuate the developing agent from the developing agent replenishing port 1b and to fill new development agent.

Further, it is possible to more perfectly remove the developing agent in the developing agent accommodation unit 4h and to fill the unit 4 with the new developing agent by using, together the step of evacuating the developing agent from the developing agent replenishing port 1b and filling the accommodation unit 4h with the new developing agent and the step of removing the development sleeve 4a, evacuating the developing agent in the developing agent accommodation unit 4h, and filling the accommodation unit 4h with the new developing agent.

In this case, it is effective to execute the step of evacuating the developing agent from the developing agent replenishing port 1b before the development sleeve removing step is executed.

Further, in the embodiment described above, there is included a case that a used process cartridge is collected and broken down, the same parts taken out from each broken-down process cartridge are grouped together, and then a process cartridge is refurbished by the refurbishing method described above using parts taken out from the used process cartridge, partly using new parts (which are not reused) when necessary. Further, in the embodiment described above there is included another case that a used process cartridge is collected and broken down, and a process cartridge is refurbished by the above-mentioned refurbishing method, using parts taken out from the used process cartridge, partly using new parts (which are not reused) when necessary, and further using parts taken out from another process cartridge.

As described above, according to the present invention, the development unit, the charging unit, and the electrophotographic photosensitive member, which constitute the process cartridge, can be broken down, positioned, and coupled with each other, respectively only by removing the side plates disposed on the sides of the process cartridge. Accordingly, the electrophotographic photosensitive member and a used developing agent can be easily replaced, and the process cartridge can be easily refurbished.

What is claimed is:

1. A method of refurbishing a process cartridge that is detachably attachable to a body of an electrophotographic image forming apparatus and comprises an electrophotographic photosensitive drum, a charging unit configured and positioned to charge the electrophotographic photosensitive drum, and a development unit configured and positioned to develop a latent image formed on the electrophotographic photosensitive drum using a development roller, wherein the electrophotographic photosensitive drum and the charging unit are attached to the development unit, said method comprising:

(a) a side plate removing step of removing first and second side plates disposed at both the lengthwise ends of the process cartridge;

(b) a charging unit detaching step of detaching the charging unit from the development unit;

(c) an electrophotographic photosensitive drum removing step of removing the electrophotographic photosensitive drum from the development unit;

(d) a shaft extracting step of extracting a shaft from the electrophotographic photosensitive drum;

(e) a shaft inserting step of inserting a shaft into a new electrophotographic photosensitive drum;

(f) an electrophotographic photosensitive drum attaching step of attaching the new electrophotographic photosensitive drum to the development unit;

(g) a charging unit attaching step of attaching the charging unit to the development unit to which the new electrophotographic photosensitive drum is attached; and (h) a positioning step of attaching the first and second side plates to the development unit to which the new electrophotographic photosensitive drum and the charging unit are attached, positioning the development unit and the charging unit with the first side plate as well as supporting the electrophotographic photosensitive drum movably in a direction perpendicular to the lengthwise direction of the process cartridge, and positioning the development unit, the charging unit and the electrophotographic photosensitive drum with the second side plate.

2. A method of refurbishing a process cartridge that is detachably attachable to a body of an electrophotographic image forming apparatus and comprises an electrophotographic photosensitive drum, a charging unit configured and positioned to charge the electrophotographic photosensitive drum, and a development unit configured and positioned to develop a latent image formed on the electrophotographic photosensitive drum using a development roller, wherein the electrophotographic photosensitive drum and the charging unit are attached to the development unit, the method comprising:

(a) a side plate removing step of removing first and second side plates disposed at both lengthwise ends of the process cartridge;

(b) a charging unit detaching step of detaching the charging unit from the development unit;

(c) an electrophotographic photosensitive drum removing step of removing the electrophotographic photosensitive drum from the development unit;

(d) an electrophotographic photosensitive drum attaching step of attaching a new electrophotographic photosensitive drum to the development unit;

(e) a charging unit attaching step of attaching the charging unit to the development unit to which the new electrophotographic photosensitive drum is attached; and (f) a positioning step of attaching the first and second side plates to the development unit to which the new electrophotographic photosensitive drum and the charging unit are attached, positioning the development unit and the charging unit with the first side plate as well as supporting the new electrophotographic photosensitive drum movably in a direction perpendicular to the lengthwise direction of the process cartridge, and positioning the development unit, the charging unit and the electrophotographic photosensitive drum with the second side plate.

3. A method of refurbishing a process cartridge according to claim 1 or 2, wherein, at said electrophotographic photosensitive drum attaching step, the first side plate is incompletely attached to the development unit to which the new electrophotographic photosensitive drum is attached, and the new electrophotographic photosensitive drum is tentatively fixed to the development unit by the first side plate.

4. A method of refurbishing a process cartridge according to claim 1 or 2, wherein, at said charging unit attaching step, a brush member attached to the charging unit is cleaned before the charging unit is attached.

5. A method of refurbishing a process cartridge according to claim 1 or 2, wherein, at any of said steps, a memory element is replaced with a memory element having different information.

6. A method of refurbishing a process cartridge that is detachably attachable to a body of an electrophotographic image forming apparatus and comprises an electrophotographic photosensitive drum, a charging unit configured and positioned to charge the electrophotographic photosensitive drum, and a development unit configured and positioned to develop a latent image formed on the electrophotographic photosensitive drum using a development roller, wherein the electrophotographic photosensitive drum and the charging unit are attached to the development unit, said method comprising:

(a) a side plate removing step of removing first and second side plates disposed at both lengthwise ends of the process cartridge;

(b) a charging unit detaching step of detaching the charging unit from the development unit;

(c) an electrophotographic photosensitive drum removing step of removing the electrophotographic photosensitive drum from the development unit;

(d) a cover member removing step of removing a cover member from the development unit, the cover member being configured and positioned to cover the surface of the development roller except for the portion thereof facing the electrophotographic photosensitive drum and to hold a sheet member in contact with the electrophotographic photosensitive drum in the lengthwise direction thereof;

(e) a pin member extracting step of extracting first and second pin members from the development unit, the first and second pin members being configured and positioned to fix bearings that rotatably support the development roller at both ends thereof;

(f) a regulation member removing step of removing a regulation member from the development unit, the regulation member being configured and positioned to regulate the angle in a rotational direction of a magnet roller included in the development roller;

(g) a development roller removing step of removing the development roller from the development unit;

(h) a developing agent evacuating step of evacuating the developing agent in the development unit from the opening of the development unit that appears when the development roller is removed;

(i) a developing agent removing step of removing the developing agent deposited on the development roller;

(j) a developing agent filling step of filling new developing agent into the development unit from the opening of the development unit;

(k) a development roller attaching step of attaching the development roller to the development unit;

(l) a regulation member attaching step of attaching the regulation member to the development unit;

(m) a pin member attaching step of attaching the first and second pin members to the development unit;

(n) a cover member attaching step of attaching the cover member to the development unit;

(o) an electrophotographic photosensitive drum attaching step of attaching the electrophotographic photosensitive drum to the development unit;

(p) a charging unit attaching step of attaching the charging unit to the development unit to which the electrophotographic photosensitive drum is attached in said electrophotographic photosensitive drum attaching step; and (q) a positioning step of attaching the first and second side plates to the development unit to which the electrophotographic photosensitive drum and the charging unit are attached in said electrophotographic photosensitive drum and charging unit attaching steps, positioning the development unit and the charging unit by the first side plate as well as supporting the electrophotographic photosensitive drum movably in a direction perpendicular to the lengthwise direction of the process cartridge, and positioning the development unit, the charging unit and the electrophotographic photosensitive drum with the second side plate.

7. A method of refurbishing a process cartridge that is detachably attachable to a body of an electrophotographic image forming apparatus and comprises an electrophotographic photosensitive drum, a charging unit configured and positioned to charge the electrophotographic photosensitive drum, and a development unit configured and positioned to develop a latent image formed on the electrophotographic photosensitive drum using a development roller, wherein the electrophotographic photosensitive drum and the charging unit are attached to the development unit, the method comprising:

(a) an open/close shutter opening step of opening an open/close shutter of a developing agent replenishing port disposed in the development unit;

(b) a first developing agent evacuating step of evacuating the developing agent in the development unit from the developing agent replenishing port whose open/close shutter is opened;

(c) an open/close shutter closing step of closing the open/close shutter;

(d) a side plate removing step of removing first and second side plates disposed at both lengthwise ends of the process cartridge thereof;

(e) a charging unit detaching step of detaching the charging unit from the development unit;

(f) an electrophotographic photosensitive drum removing step of removing the electrophotographic photosensitive drum from the development unit;

(g) a cover member removing step of removing a cover member from the development unit, the cover member being configured and positioned to cover the surface of the development roller except for the portion thereof facing the electrophotographic photosensitive drum and to hold a sheet member in contact with the electrophotographic photosensitive drum in the lengthwise direction;

(h) a pin member extracting step of extracting first and second pin members for the development unit, the first and second pin members being configured and positioned to fi bearings that rotatably support the development roller at both the ends thereof;

(i) a regulation member removing step of removing a regulation member from the development unit, the regulating member being configured and positioned to regulate the angle in a rotational direction of a magnet roller included in the development roller;

(j) a development roller removing step of removing the development roller from the development unit;

(k) a second developing agent evacuating step of evacuating the developing agent in the development unit from the opening of the development unit that appears when the development roller is removed;

(l) a developing agent removing step of removing the developing agent deposited on the development roller;

(m) a developing agent filling step of filling the development unit with new developing agent from the opening of the development unit;

(n) a development roller attaching step of attaching the development roller to the development unit;

(o) a regulation member attaching step of attaching the regulation member to the development unit;

(p) a pin member attaching step of attaching the first and second pin members to the development unit;

(q) a cover member attaching step of attaching the cover member to the development unit;

(r) an electrophotographic photosensitive drum attaching step of attaching the electrophotographic photosensitive drum to the development unit;

(s) a charging unit attaching step of attaching the charging unit to the development unit to which the electrophotographic photosensitive drum is attached in said electrophotographic photosensitive drum attaching step; and (t) a positioning step of attaching the first and second side plates to the development unit to which the electrophotographic photosensitive drum and the charging unit are attached in said charging unit attaching step and in said electrophotographic photosensitive drum attaching step, positioning the development unit and the charging unit with the first side plate as well as supporting the electrophotographic photosensitive drum movably in a direction perpendicular to the lengthwise direction, and positioning the development unit, the charging unit and the electrophotographic photosensitive drum with the second side plate.

8. A method of refurbishing a process cartridge according to claim 6 or 7, wherein, at the electrophotographic photosensitive drum attaching step, the first side plate is attached up to a midpoint of the development unit to which the electrophotographic photosensitive drum is attached, and the electrophotographic photosensitive drum is tentatively fixed to the development unit by the first side plate.

9. A method of refurbishing a process cartridge according to claim 6 or 7, wherein, at said charging unit attaching step, a brush member attached to the charging unit is cleaned before the charging unit is attached.

10. A method of refurbishing a process cartridge according to claim 6 or 7, wherein, at the developing agent removing step, the development roller is replaced with a new development roller.

11. A method of refurbishing a process cartridge according to claim 6 or 7, wherein said cover member removing step, said pin member extracting step, and said regulation member removing step are executed in random order.

12. A method of refurbishing a process cartridge according to claim 6 or 7, wherein said regulation member attaching step, said pin member attaching step, and said cover member attaching step are executed in random order.

13. A method of refurbishing a process cartridge according to claim 6 or 7, wherein, at any of said steps, a memory element is replaced with a memory element having different information.

14. A method of refurbishing a process cartridge according to claim 6 or 7, wherein said open/close shutter opening step, said developing agent evacuating step, and said open/close shutter closing step are executed at any time prior to said development roller removing step.

* * * * *

UNITED STATES PATENT AND TRADEMARK OFFICE

CERTIFICATE OF CORRECTION

PATENT NO. : 6,970,668 B2
APPLICATION NO. : 10/691546
DATED : November 29, 2005
INVENTOR(S) : Takahito Ueno et al.

It is certified that error appears in the above-identified patent and that said Letters Patent is hereby corrected as shown below:

COLUMN 9
Line 30, “entirely” should read --entirety--.

COLUMN 12
Line 31, “to” should read --into--.

COLUMN 13
Line 32, “as” should read --so as--.

COLUMN 14
Line 31, “to” should read --into--.

COLUMN 18
Line 54, “couples” should read --couple--.
Line 59, “couples” should read --couple--.

COLUMN 23
Line 64, “moved” should read --moved in--.

COLUMN 24
Line 10, “evacuating” should read --a step of evacuating--.

COLUMN 27
Line 1, “by” should read --with--.
Line 45, “for” should read --from--.
Line 47, “fi” should read --fix--.

UNITED STATES PATENT AND TRADEMARK OFFICE

CERTIFICATE OF CORRECTION

PATENT NO. : 6,970,668 B2
APPLICATION NO. : 10/691546
DATED : November 29, 2005
INVENTOR(S) : Takahito Ueno et al.

It is certified that error appears in the above-identified patent and that said Letters Patent is hereby corrected as shown below:

COLUMN 28
Line 57, "claim 6 or 7," should read --claim 7,--.

Signed and Sealed this

Fourteenth Day of August, 2007

JON W. DUDAS
*Director of the United States Patent and Trademark Office*